US010196115B2

(12) United States Patent
Lydle

(10) Patent No.: US 10,196,115 B2
(45) **Date of Patent: *Feb. 5, 2019**

(54) WATERCRAFT DRY DOCK STORAGE SYSTEM AND METHOD

(71) Applicant: Richard C. Lydle, Palm Beach Gardens, FL (US)

(72) Inventor: Richard C. Lydle, Palm Beach Gardens, FL (US)

(73) Assignee: THE RICHARD C. LYDLE REVOCABLE TRUST, Palm Beach Gardens, FL (US)

( * ) Notice: Subject to any disclaimer, the term of this patent is extended or adjusted under 35 U.S.C. 154(b) by 362 days.

This patent is subject to a terminal disclaimer.

(21) Appl. No.: 14/093,988

(22) Filed: Dec. 2, 2013

(65) Prior Publication Data

US 2014/0154034 A1 Jun. 5, 2014

Related U.S. Application Data

(63) Continuation of application No. 12/865,017, filed as application No. PCT/US2009/032253 on Jan. 28, 2009, now Pat. No. 8,596,946.

(Continued)

(51) Int. Cl.
*B63C 1/00* (2006.01)
*B63C 3/06* (2006.01)

(Continued)

(52) U.S. Cl.
CPC ..... *B63C 1/00* (2013.01); *B63C 3/06* (2013.01); *B63C 3/12* (2013.01); *B63C 15/00* (2013.01)

(58) Field of Classification Search
CPC .. B65G 1/0435; B65G 1/0407; B65G 1/0414; B65G 1/1378; B65D 88/32; B63B 27/36;

(Continued)

(56) References Cited

U.S. PATENT DOCUMENTS 3,189,198 A 6/1965 Filak
3,372,817 A 3/1968 Conklin (Continued)

FOREIGN PATENT DOCUMENTS

FR 2864518 7/2005
FR 2920405 3/2009

(Continued)

OTHER PUBLICATIONS

International Search Report and Written Opinion for PCT/US2009/032253.

*Primary Examiner* — Stephen A Vu
(74) *Attorney, Agent, or Firm* — Hahn Loeser + Parks LLP; Scott M. Oldham, Esq.

(57) ABSTRACT

There is provided a storage system for storing and retrieving watercraft or other items to or from a storage position in a storage area as part of an enclosure having a plurality of storage areas. The storage system may include at least one carrier to support the item during movement to or from a storage position, and a positioning system to move the carrier system. An elevator system is usable to move the positioning system and carrier system to and from a storage area, and a control system is usable to control the positioning system to move the carrier system and item into and out of its storage position.

20 Claims, 55 Drawing Sheets

Related U.S. Application Data

(60) Provisional application No. 61/024,024, filed on Jan. 28, 2008.

(51) Int. Cl.
*B63C 3/12* (2006.01)
*B63C 15/00* (2006.01)

(58) Field of Classification Search
CPC .... B63B 9/00; B63C 3/06; B63C 1/00; B63C 3/12; B63C 15/00; E04H 6/282
USPC ..... 414/266, 268, 277, 279, 285, 807, 263; 114/258, 48; 405/4
See application file for complete search history.

(56) References Cited

U.S. PATENT DOCUMENTS

| | | | | |
|---|---|---|---|---|
| 3,927,773 | A * | 12/1975 | Bright | 414/273 |
| 4,070,979 | A | 1/1978 | Otis et al. | |
| 4,190,013 | A | 2/1980 | Otis et al. | |
| 4,640,214 | A | 2/1987 | Bruns | |
| 4,726,316 | A | 2/1988 | Bruns | |
| 4,787,804 | A | 11/1988 | Edenas | |
| 4,797,055 | A | 1/1989 | Tworoger et al. | |
| 5,314,285 | A | 5/1994 | Lai | |
| 5,388,945 | A * | 2/1995 | Garric et al. | 414/217.1 |
| 5,487,636 | A | 1/1996 | Mkrtchyan | |
| 5,511,923 | A * | 4/1996 | Dunstan | 414/139.9 |
| 6,007,288 | A | 12/1999 | Maffett et al. | |
| 6,929,440 | B1 * | 8/2005 | Grond | 414/284 |
| 7,112,007 | B2 | 9/2006 | Maffett et al. | |
| 7,850,412 | B2 * | 12/2010 | Benedict | B63C 15/00 114/44 |
| 2002/0071744 | A1 * | 6/2002 | Bachrach | 414/217 |
| 2002/0176767 | A1 | 11/2002 | Gisselberg | |
| 2004/0265096 | A1 | 12/2004 | James | |
| 2007/0031218 | A1 * | 2/2007 | Haag | 414/227 |
| 2010/0247275 | A1 * | 9/2010 | Karlen et al. | 414/286 |

FOREIGN PATENT DOCUMENTS

| | | |
|---|---|---|
| JP | 05010195 | 2/1993 |
| JP | 02594667 | 3/1997 |
| JP | 11059586 | 3/1999 |
| JP | 11208584 | 8/1999 |
| JP | 03044475 | 5/2000 |

* cited by examiner

WATERCRAFT DRY DOCK STORAGE SYSTEM AND METHOD

CROSS REFERENCE TO RELATED APPLICATION

This patent application is a continuation application of U.S. patent application Ser. No. 12/865,017 filed Oct. 27, 2010, which has been issued as U.S. Pat. No. 8,596,946, issued on Dec. 13, 2013, which is a national stage application of PCT/US09/32253, filed Jan. 28, 2009, which claims priority to and the benefit of U.S. Provisional Patent Application Ser. No. 61/024,024 filed Jan. 28, 2008, which are incorporated herein by reference.

TECHNICAL FIELD

The present invention relates generally to a craft storage system, such as for watercraft, aircraft or other items in a space efficient and effective manner. More particularly, examples of this invention relate to a dry stack craft storage system that uses a carrier system for supporting the craft, with the carrier assembly mating with a support system provided in association with a bay or berth of the storage system, for receiving the craft with the carrier system. In an example, the carrier system and craft are lifted into the proper position in the bay or berth by a lifting frame and lifting system. Craft operational systems may be provided for connection of the craft to utilities or the like, such as for electric and/or plumbing. A computer control system may be used to control operation of the various systems, including the lift and positioning systems, craft operational systems and/or other systems of the invention. The storage system is adaptable and adjustable to different sized/shaped craft or other items, and may provide systems for maintaining the craft systems operational.

BACKGROUND OF THE INVENTION

Dry watercraft storage systems have been developed for enabling the convenient storage of watercraft for use of the watercraft while providing storage in a dry docked condition. Such facilities are generally arranged with a number of berths formed by framework in a building constructed on the body of water, to allow a boat to enter and be lifted into a berth for storage. A lifting system, such as a fork lift, overhead crane or other systems have been used to position the boat in a berth. Though somewhat effective, there are various deficiencies associated with such facilities, including the need for implementing a more efficient dry watercraft storage system which can handle and store a large number of watercraft configurations and sizes. As watercraft come in a wide variety of types, shapes and sizes, it would be desirable to provide a system which can accommodate these wide variations. Further, for large watercraft, it would be desirable to provide support that ensures safe storage over extended periods. It would also be desirable to provide a system which allows for optimized use of the berth space available for use, based on the types of watercraft being stored.

Another deficiency of such facilities is that for shorter storage applications, where it is desired to use the watercraft often and dry store it to extend its life, such facilities do not provide desired storage capabilities to maintain the watercraft in condition for use.

SUMMARY OF THE INVENTION

The present invention provides a dry stack watercraft storage system for storing and retrieving watercraft from a body of water. The storage system generally comprises an enclosure having a support system provided therein to form a series of storage positions for watercraft. The support system may be of various types, including one or more floor supports, on which a plurality of watercraft may be positioned and stored via a carousel or tram system to allow movement of the watercraft on the support floor. Alternatively, the support system may comprise a framework system generally forming a plurality of berths or bays in a stacked configuration. Further, a plurality of support columns and cross beams may be used to form a series of berths, wherein the size of the berths is adjustable for accommodating different size craft. The enclosure for the support system may include walls and a roof, and may be formed of any type of material of the builder's choice. The walls of the enclosure may be attached directly to the exterior of the framework system to provide an external protection for the watercraft in the storage system. In an example, a positioning system is provided to position the watercraft on the support system. Depending on the desired storage position of the watercraft, the positioning system may include a lifting system to elevate the watercraft and position the watercraft on a tram or sled system provided on a support floor or into a berth. As an example, a positioning system may be provided as an elevator system, such as a rigid chain lift or other suitable elevator system, a trolley bridge adjacent or in the enclosure to provide support for a bridge-crane trolley, or other suitable systems to provide lifting and positioning of watercraft into the desired position in the storage facility. A cradle system may be used in association with the positioning system to interface with a carrier system made to support a watercraft, wherein the carrier system may be selectively positioned in association with the cradle assembly, and together with the watercraft positioned thereon, allows a watercraft to be positioned on the support system in association with its carrier system.

The cradle assembly may include a system for interlocking with the carrier system during lifting and positioning. The cradle system may also have an adjustable width to accommodate different width watercraft. The carrier system may include one or more stops to position the carrier and watercraft in a predetermined position on the cantilever support. There may also be provided watercraft operational systems for connection of the watercraft to utilities or the like. A computer control system may be used to control operation of the lift system, watercraft operational systems and/or other systems of the invention. Watercraft operational systems may include an electric supply system and/or fluid supply system to be selectively coupled to the electric system and fluid circulation system of the watercraft when stored in the facility.

The lifting and positioning system to position a watercraft in a storage position in the storage system, may be any suitable positioning system. Such systems may include a crane lifting and positioning system, an elevator system to provide elevation of a watercraft into a desired storage position with its carrier, and/or a vertical transfer system. Also, the support system may be adapted to mate with the carrier and associated watercraft, such as via a carrier support system, a support beam, a track system, rail system or other suitable systems to receive and lock the carrier therewith. Further aspects of the invention will become apparent upon a reading of the following description of an example thereof in association with the figures.

DESCRIPTION OF THE INVENTION

Figure 1:
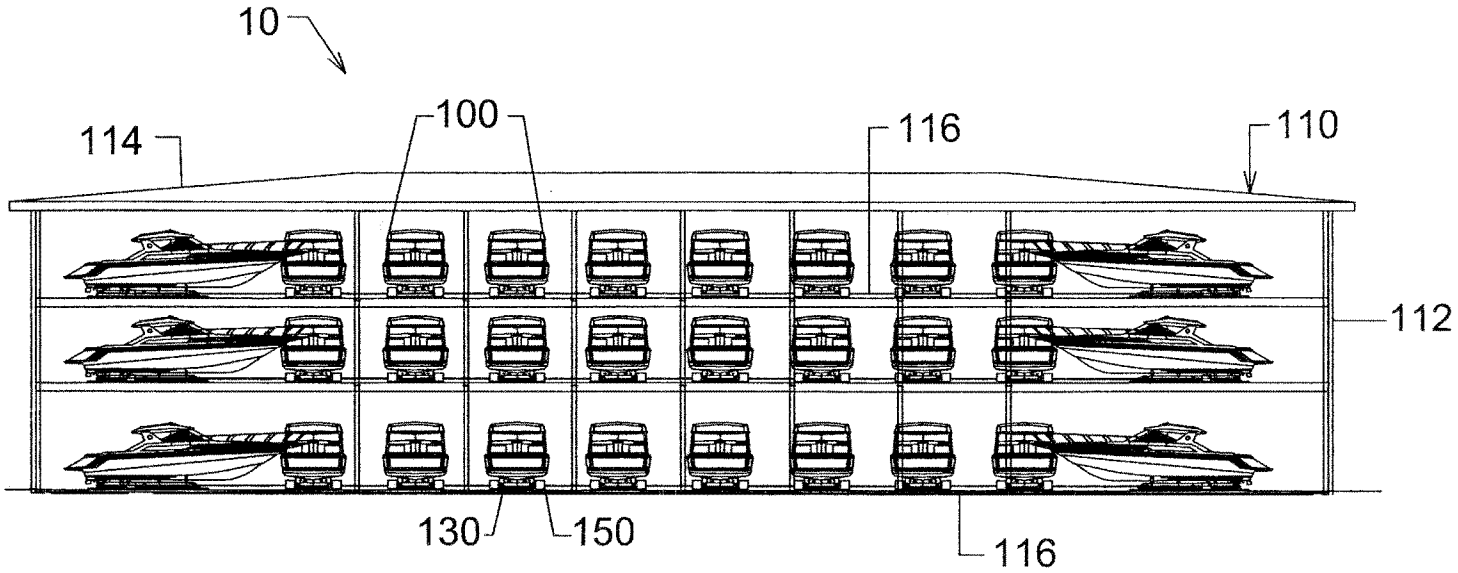
FIG. 1 is a cross sectional view of an example of the dry stack watercraft storage system according to an example of the invention.
Figure 2:
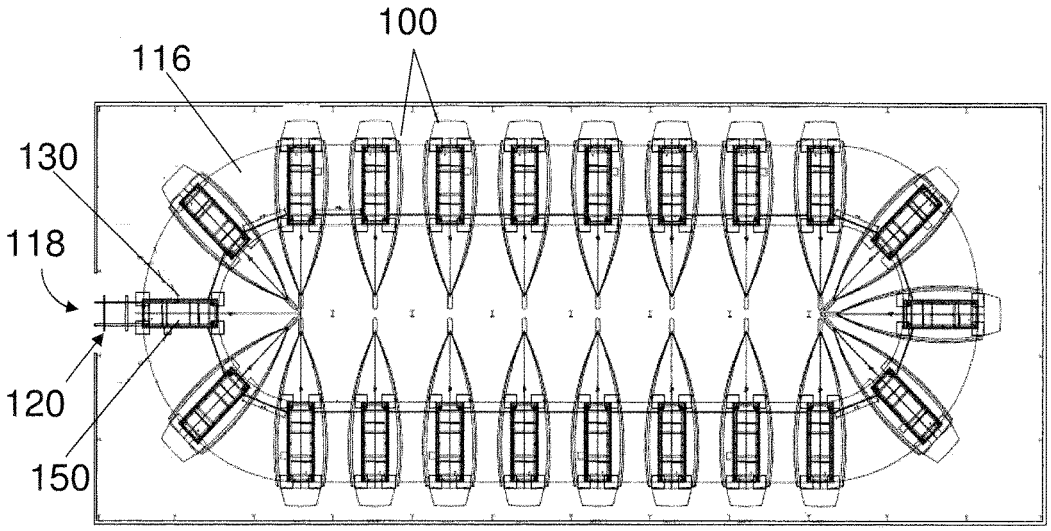
FIG. 2 is a top view of a conveyor support system for storage of a plurality of watercraft according to the example of FIG. 1.

An example of the dry watercraft storage facility 10 according to the invention is shown in FIGS. 1-12. The storage system may be designed for storing and retrieving watercraft 100 from a body of water for short term or longer term storage. The system may be designed to allow watercraft 100 to be loaded into storage directly from the water, and selectively and put back into the water for use directly from storage. Such a facility 10 may also be used to store other vehicles or products, such as aircraft, large shipping and storage containers, automobiles and a variety of other items. In the example shown, the facility 10 may include a water channel that enters the facility, or may be located adjacent a body of water to allow transfer from the water to the facility. If needed, an intermediate positioning system may be used to move a watercraft from a body of water to a positioning system associated with the facility, as will hereinafter be described. As seen in FIGS. 1 and 2, the storage system may be provided in an enclosure 110, such as a building, in which the storage system is integrated. The enclosure 110 may be of any suitable type, and generally will include side walls 112 and a roof 114, with an open interior. In this example, a plurality of support floors or suitable structures 116 may be provided around the periphery of the enclosure 110, such as in an oval type of shape or any other desired configuration. As shown in FIG. 2, the enclosure 110 may have one or more opening or door 118 through which watercraft 100 may be introduced into the enclosure 110, and positioned on any of the plurality of support floors 116. A transfer system 120 or any other suitable structure may be used to facilitate transfer of a watercraft 100 into the facility, and as will be described below, could be formed to interface with a carrier system 130 associated with a watercraft 100. As will be described more fully below, the watercraft 100 may be introduced into the facility 100 on its carrier 130 and positioned on a tram system 150 (FIGS. 9-11) to allow movement of the watercraft on the support floor 116. As seen in this example, a large number of watercraft 100 can be selectively stored on each of the support floors 116 in facility 100. In the configuration shown in FIGS. 1 and 2, the oval configuration of the support floors or paths 116 may take advantage of the typical shape of watercraft 100, which may have a tapered forward hull portion, which allows closer packing of watercraft 100 on the supports 116, while allowing for movement along the supports 116 via the tram system 150. It thus should be recognized that a watercraft 100 to be stored in facility 10 can be introduced onto any open storage position on the supports 116, and then the entire series of stored watercraft 100 can be moved around the supports 116 via the tram system 150 or other suitable conveyance system. Stored watercraft may then be easily retrieved from storage by moving the watercraft to the position of the door 118, so as to be selectively removed from the tram system 150 and support 116, and positioned back in the water for use. The facility 10 may further comprise fire suppression systems (not shown) situated above the watercraft 100 may be any suitable system that is accepted by local, state or national fire code, and may be of any suitable configuration. In general, the fire suppression system will be mounted above each support track 116 so as to be positioned above watercraft 100 positioned thereon. For many situations, the fire suppression system may be provided such that each watercraft in the facility is protected by an individual fire suppression system.

In this example, one or more main positioning and/or lifting systems (not shown) may be provided to position and/or lift and position watercraft 100 from the water onto the transfer system 120. Although shown schematically, the transfer system 120 may be of any suitable configuration to allow a watercraft 100 and associated carrier 130 to be positioned thereon, and then to allow the watercraft 100 to be moved into position on the support 116 and tram system 150. The one or more positioning and/or lifting systems may also be of any suitable type, such as to facilitate handling of different types and sizes of watercraft, and efficiently positioning watercraft 100 into the system 10. As an example, bridge cranes may be used, having different lifting capacities (e.g. 30 ton and 50 ton cranes) as may be needed. To increase the speed of watercraft storage or retrieval or boat throughput, one or more further intermediate positioning and/or lifting systems (not shown) may be used to allow the boat to be removed or launched from or into the water by transferring the boat carrier onto or from the intermediate lifting system and to and from a main positioning and/or lifting system for example. In an example, the positioning and/or lifting system is a plurality of vertical lifting and lateral positioning systems to raise or lower the watercraft and move the watercraft into or out of facility 10, with the plurality of vertical lifting systems being articulated or not articulated for transfer of watercraft both to and from a body of water and/or to and from a support system. Other suitable positioning and/or lifting systems are also contemplated, such as stacker cranes, captive aisle cranes, heavy equipment, elevator type systems or the like.

The system in examples, whether employing one or more positioning and/or lifting systems, may therefore be situated adjacent to the body of water, and a water channel may be provided in the building 110 or adjacent the building 110 if zoning or permitting does not allow a channel to enter into the building 110. An intermediate or further positioning and/or lifting system may be used for lifting and launching of a watercraft external to the building 110, to move the watercraft into the storage facility 10, and from which the watercraft can be retrieved or positioned for use or storage.

Figure 5:
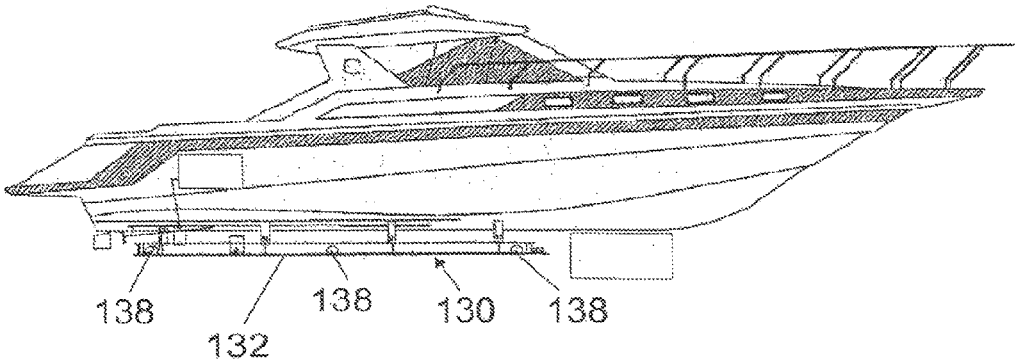
FIG. 5 is a side view of a watercraft positioned on the carrier system shown in FIG. 3.

Depending on the size, length, width or other parameters of the watercraft 100, a carrier 130 is configured for a particular watercraft 100, to provide proper support for the watercraft 100 in a storage position. The carrier 130 is shown in more detail in FIGS. 3-5, and may comprise an elongated frame 132 formed of steel or other suitable material, having a plurality of locking devices 134 provided therewith to lock the position of the carrier 130 with respect to the tram system 150 when positioned thereon. The locking devices 134 may be of any suitable type, and serve to prevent unwanted movement of the carrier 130 when positioned on a tram system 150. Also arranged along the length of the carrier 130 may be provided a plurality of hull supports 136, one of which is shown in more detail in FIG. 4. The hull supports 136 are formed to support the watercraft hull in association with the carrier 130, and may be formed to have a configuration which matches the shape of the hull of a watercraft 100 at the location at which each hull support 136 is positioned relative to hull 102, as shown in FIG. 5. Each hull support 136 may be particularly formed in association with a particular watercraft 100, and in association with the carrier 130, designed to support the watercraft 100 in the desired manner, with the weight and load of the watercraft being distributed properly on the carrier 130. As should be recognized, the carrier 130 and associated hull supports 136 shown in the FIGS., is only one example, and the characteristics of the carrier 130 and hull supports 136 are adaptable to any watercraft 100, such as the alternative lengths or widths, using a different number or dimensions for the hull supports 136, or with other hull shapes, such as twin or triple hull shapes to mention but a few hull styles anticipated, or new styles not yet developed. The hull supports 136 may also be configured for simple fabrication to match the shape of the watercraft hull as desired. The hull supports 136 may be formed of a base and at least one upper support surface that may be deformed by the actual watercraft hull or otherwise formed to match the shape of the hull. In this way, the carrier and hull supports are specifically designed to accommodate a particular watercraft 100 in a predetermined manner. Depending on the particular characteristics of a watercraft 100, the center of gravity and other characteristics of the watercraft are accounted for in designing each carrier 130 and hull supports 136 associated therewith. The carrier 130 is then positionable using a positioning and/or lifting system for example, which may include a cradle system interfacing with the carrier 130, as will be described below, in a particular location on the tram system 150 to provide optimized support of a particular watercraft 100.

Figure 3:
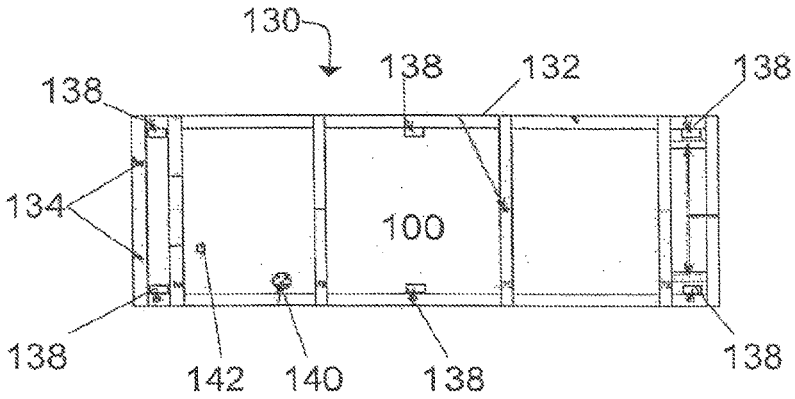
FIG. 3 is a top view of a carrier system according to an example.
Figure 4:
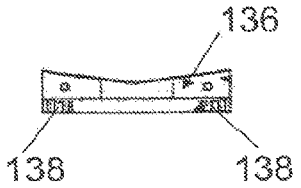
FIG. 4 is a front view of the carrier system shown in FIG. 3.

As also shown in FIGS. 3 and 5, and as will be described in further detail hereafter, the carrier 30 may also comprise watercraft operational systems for connection of the watercraft 100 to utilities or the like. Such watercraft operational systems may be used to maintain the watercraft 100 in a desired condition when in storage. Watercraft operational systems may include an electric supply system 140 and water circulation system 142 for example. The electric supply system 140 is designed to mate with an electrical coupling of the watercraft 100, to supply electric power to any or all watercraft systems as desired. For example, many watercraft 100 have electric appliances, utilities, lights, equipment, dehumidifiers, air conditioning, ice makers, or other electric and/or water operated devices or systems, and the present invention allows electric power of any suitable type to be supplied to the watercraft 100 during storage. In this way, any or all watercraft systems can be maintained operational during storage, to facilitate use for a variety of situations. As an example, the user may wish to store their watercraft 100 for short periods between uses, and it would be desirable to maintain the appliances, such as a refrigerator, in operational condition to maintain food and beverages or the like that are on board. Similarly, it may be desirable to maintain operation of the dehumidifier system and/or air conditioning system to allow use of the watercraft on short notice without the need for extended preparations. It should be recognized that any electrically powered device or systems can thus be maintained in operational condition if desired. To further facilitate these abilities, there may also be provided a water or coolant circulation system 142 for use in maintaining the air conditioning system of a watercraft 100 in operational condition. In many watercraft 100, the air conditioning system includes a water circulation system for facilitating heat transfer. Typically, water from the body of water in which the watercraft 100 is operated may be used to provide circulated water for the air conditioning system. When stored in the facility 10, the present invention therefore provides a water circulation system 142 to supply water (or other suitable fluid) to the air conditioning system of the watercraft 100, thereby allowing the air conditioning system to remain operational. Water may also be supplied for use or consumption on watercraft 100, for the ice maker or other systems if desired. Other systems associated with a watercraft 100 may also be accommodated in accordance with the invention, such as a system for waste removal from the watercraft or the like. For safety and proper operation, the electrical or plumbing connections may include sensors detecting proper connection prior to having the electric power or water supply remotely activated for each watercraft for example. A suitable computer control system may be used to control operation of such systems.

In this example, the carrier 130 may further include a plurality of guide wheels 138 which mate with a wheel guide and support system associated with a tram system 150 or cradle described below for example. The number of wheels 138 may be suitable for the particular watercraft 100. The locking or anti-roll system 134 may simply be a stop block or blocks which are selectively moved into a position to prevent outward movement of the guide wheels 138 and carrier 130 from the tram system 150 or cradle described below. The carrier 130 may include a system to selectively fix it in place relative to other structures.

Figure 6:
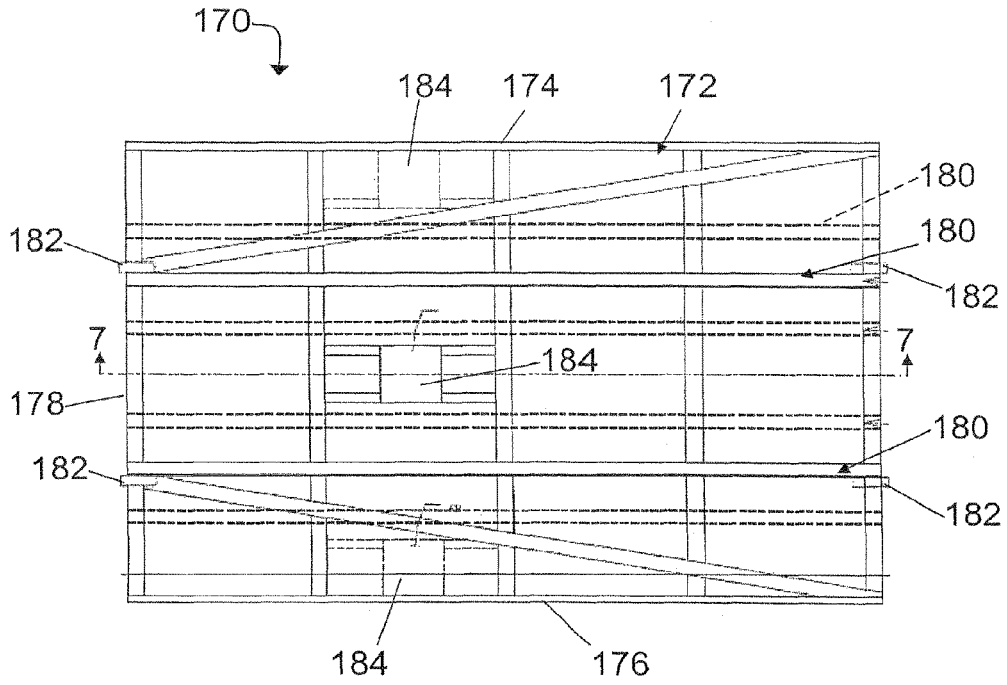
FIG. 6 is a top view of an example of a cradle system for use in the storage system.
Figure 7:
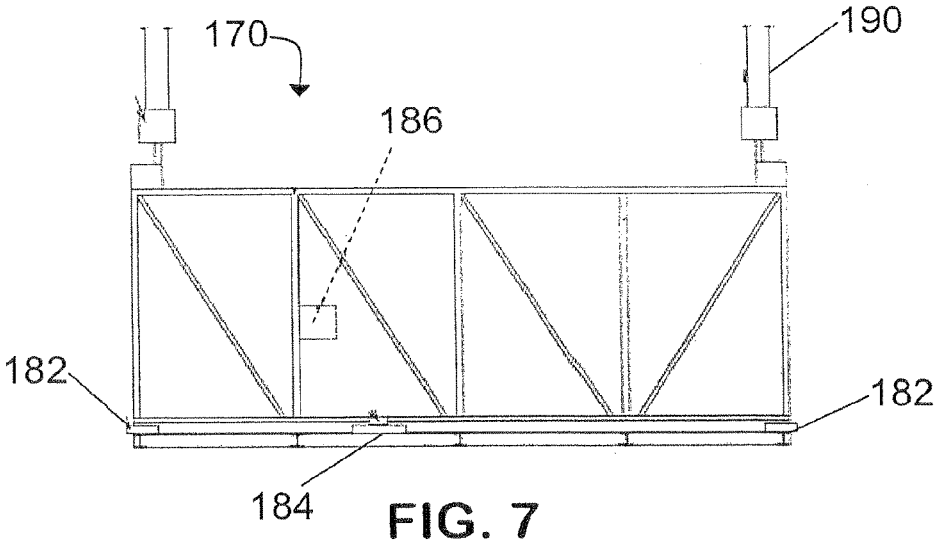
FIG. 7 is a cross sectional view taken along line 7-7 of FIG. 6 of this example of the cradle system.
Figure 8:
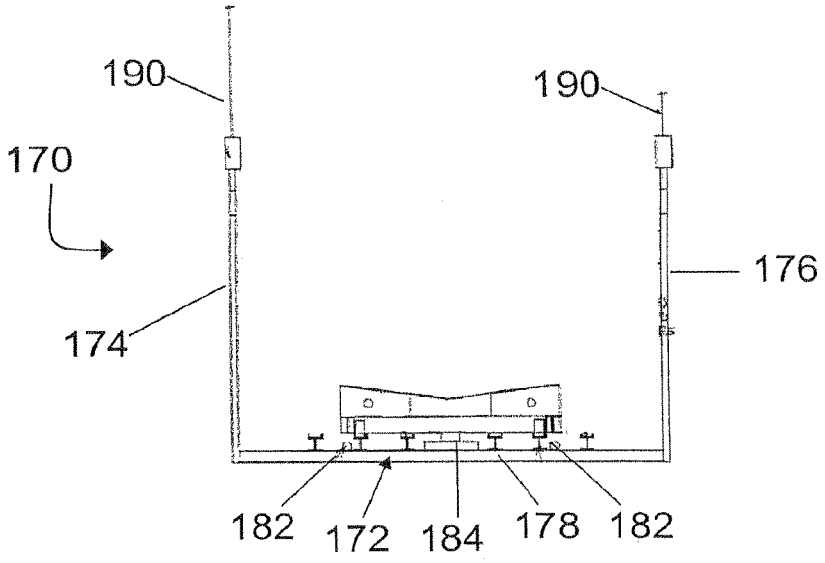
FIG. 8 is an end view of the cradle system as shown in FIG. 6.
Figure 9:
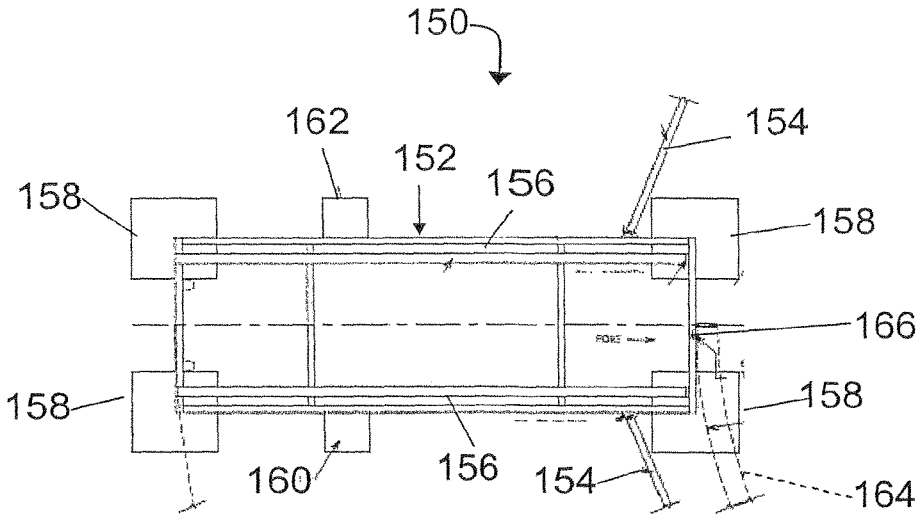
FIG. 9 is a top view of a tram system for use in positioning a watercraft on the watercraft support system.
Figure 10:
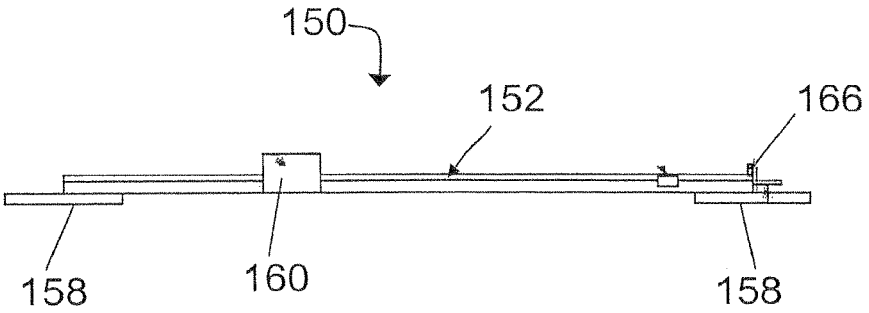
FIG. 10 is a side view of the tram system shown in FIG. 9.
Figure 11:
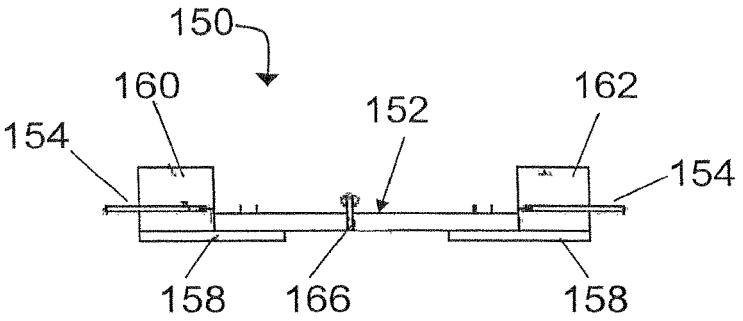
FIG. 11 is a front view of the train system shown in FIG. 9.
Figure 12:
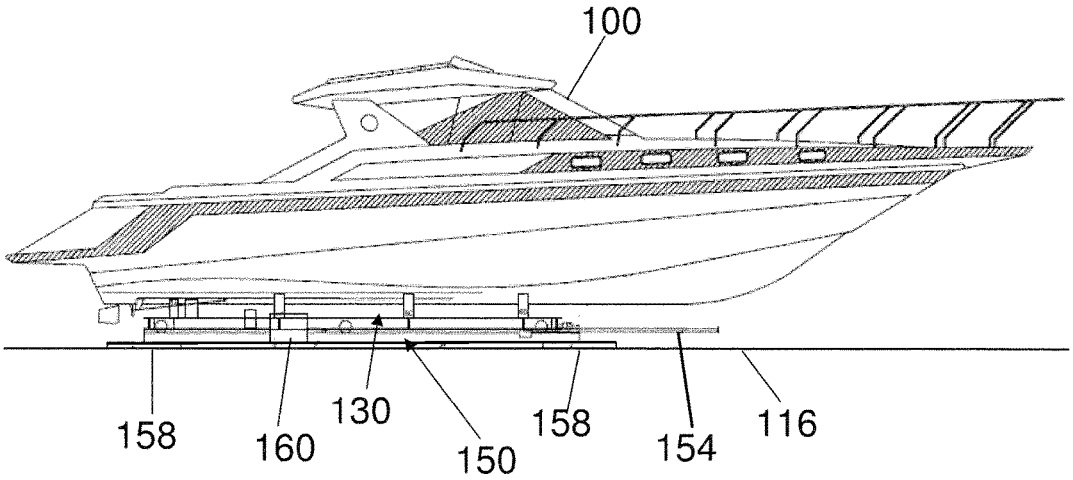
FIG. 12 is a side view of a watercraft positioned on its carrier system and on a tram system in a storage position on the support system.

In an alternate embodiment as shown in FIGS. 6-8, to facilitate movement of the watercraft 100 and carrier 130, such as by a suitable positioning and/or lifting system as described, a cradle system 170 may be used. The cradle system 170 may be coupled to crane lift cables 190 for example. The watercraft 100 and carrier 130 may be interfaced with the cradle 170 for lifting and positioning on the transfer system 120 in this example. A positioning system such as a crane may be used to lift the cradle 170 in association with the watercraft 100 and carrier 130. The cradle assembly 170 may comprise a frame assembly 172 having a first side 174, second side 176 having a predetermined height, which may be configured to exceed the keel to gunnel height of watercraft to be handled. A bottom frame wall 178 supports a wheel guide and support system 180 which mates with the guide wheels 138 on the carrier 130 to position the carrier 130 and watercraft 100 thereon, to be lifted and positioned by the lifting system. The wheel guide and support system 180 may comprise a plurality of guide rails, as may be desired for various watercraft. It should also be recognized that the wheels could be provided on the cradle 170 and guides associated with the carrier 130 if desired.

The frame assembly 172 may provide open ends into which the watercraft 100 may be maneuvered in the body of water for loading, or for loading from an intermediate lifting and positioning system. The locking system 134 associated with the carrier 130 may be provided for locking the carrier 130 or preventing movement thereof from the cradle system 170. Alternatively, an anti-roll locking system may be provided in association with the cradle 170. In the example shown, to further facilitate safe transfer of the carrier/watercraft from the cradle system 170 onto the transfer system 120 and support system 116, the cradle 170 may comprise locating members 182 which may be interlocked with rake pins, clamps or any other suitable device or method, at the proper location relative to the transfer system 120 or other structures. The interface with the transfer system 120 may also include mating pins, clamps or the like, to ensure alignment of the guide rails 180 on the cradle 170 with the guide rails associated with the transfer system 120 for example, both horizontally and vertically.

To facilitate transfer of the carrier/watercraft from the cradle 170 onto support system 116 or from support system 116 and onto cradle 170, one or more suitable transfer systems 184 may be provided in association with the cradle 170 (and/or support system 116) to push, pull or otherwise transfer the carrier 130 from or onto the cradle 170. The transfer system 184 as an example, may be a hydraulic motor, hydraulic cylinder, a driven roller or wheel acting on the carrier 130 or any other suitable device or method. Alternatively, the transfer system 186 may be positioned such as shown in FIG. 7, to act on the watercraft 100 positioned therein. It should be recognized in this example, that the cradle system 170 allows movement of the carrier/watercraft into or from a storage position on support 116. The carrier/watercraft is rolled onto and from the support system 116 and cradle 170, when the cradle 170 is positioned adjacent the door 118 and transfer system 120. To accommodate various width watercraft 100, the cradle system 170 may have an adjustable width, such as by an adjustable width bottom frame 178 or multiple or differently spaced wheel guide and support system 180 as shown in FIG. 6. Similarly, the width or position of the crane cables 190 can be adjusted in association with the lifting and positioning system in any suitable manner.

In this example, the carrier 130 is selectively moved into or from a storage position on support 116, onto or from a tram system 150. The tram system 150 may be of any suitable type, and in the example shown (FIGS. 9-11), comprises a plurality of support frames 152 to accommodate carriers 130 on each support frame. The support frames 152 may be connected together to allow movement of the series of support frames 152 around the support track 116 in the facility 10. For example, each tram support frame 152 may have articulating arms 154 which interconnect with other tram support frames 152, which in the example shown, may be in a circular or oval configuration. Thus, the entire tram system 150 formed of a series of tram support frames 152 can move around track support 116, such that each of the tram frames 152 may be positioned at the location of the building opening(s) 118, for storage or removal of a watercraft therefrom. A wheel guide system 156 interfaces with the guide wheels of carrier 130 similar to the cradle system as described previously, or vice versa. To allow movement of each of the tram frames 154, air bearings 158 may be used on each corner thereof, or any other suitable system to allow movement of support frames 152 may be used. A system for supplying air 160 may be provided for operation of the air bearings 158. To facilitate movement of the system of tram support frames 152, each may include a tram puller tractor system 162, providing each tram support frame 152 with a drive system, which can then work in conjunction to move the entire tram system as needed. It should also be understood that any other suitable drive system for the tram system 150 may be used. Further, the use of any other suitable tram or conveyor type system for supporting and moving the stored watercraft 100 is contemplated. The tram support frames 152 may move along a path following the support floor or track or support 116 as seen in FIG. 2. As mentioned above, it may be desired to provide watercraft operational systems in association with the stored watercraft 100. The carrier 130 was described as having an electric supply system 140 and/or a water circulation system 142 for example. To interface with the carrier 130, the support track 116 may include an electric and water circulation connection system to supply the operational systems of the watercraft 100. In this example, the support track 116 may have an electric raceway 164 and electric connection 166 associated with the tram support frame, which interfaces with the electric supply system 140 on the carrier 130. It should be evident that as the carrier 130 moves along the support track 116, the electrical connection via the raceway 164 and connector 166 allows electric power to be supplied to the carrier 130 and watercraft positioned thereon, regardless of its position on the track support 116. Other operational systems may be supplied to the watercraft when stored, at their location on the track support 116. Fire suppression systems may also be provided to suppress fire in any watercraft stored along track or support 116.

In this example, the conveyor system associated with the support track 116 may be computer controlled. Further, in operation, a facility may have a lifting and positioning system in or outside of the facility to handle the watercraft loading and unloading to and from storage. The watercraft is positioned in association with its carrier 130, and may then be moved via the positioning system. In the example described, a crane may be positioned inside and/or outside of the building 10, and interfaced with a cradle to lift the carrier and watercraft out of water. The watercraft is lifted to the desired level of the support tracks provided in the facility and the crane lifts cradle slightly above the transfer system or carrier 120, and then is moved into the transfer system or carrier so that alignment pins can be engaged with the carrier 130. The crane may then be operated to lower the boat on locking pins, and the boat is transferred to or from the transfer carrier from or onto the cradle. The boat 100 and carrier 130 is pushed onto/into the transfer carrier to stops provided in association therewith. The crane then lifts up, and a mechanical trip lock falls into place assuring the boat 100 and carrier 130 do not move after being positioned on the tram carrier 150. The crane lifts up to disengage the locking pins, and may then be used to move and position another boat from the water or to another level in facility 10 or to another facility as desired. The crane can service multiple buildings if desired. If the crane is positioned outside the facility 10, it may operate in set back areas of the facility 10. In this example, to provide flexibility in handling different watercraft, the support tracks 116 may be adjustably positioned relative to the ground and/or other support levels if desired.

Figure 13:
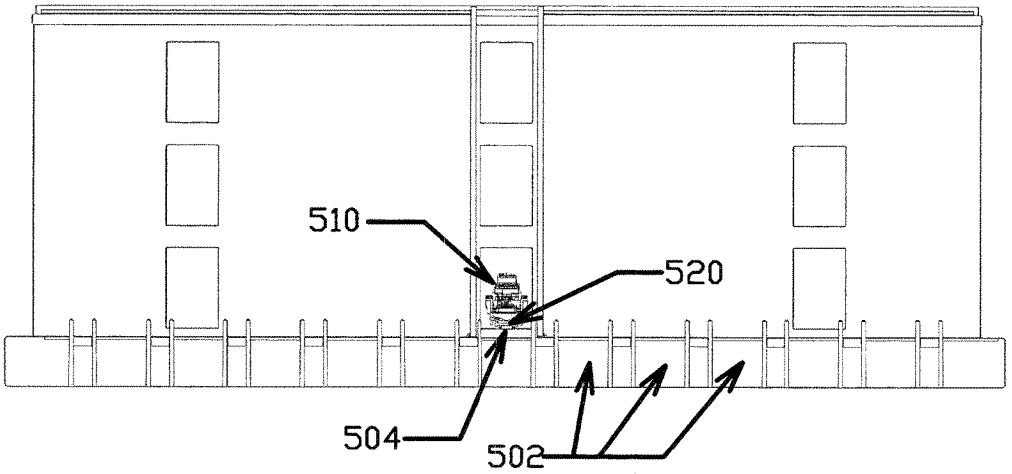
FIG. 13 shows a view of another example of a storage system of the invention.
Figure 14:
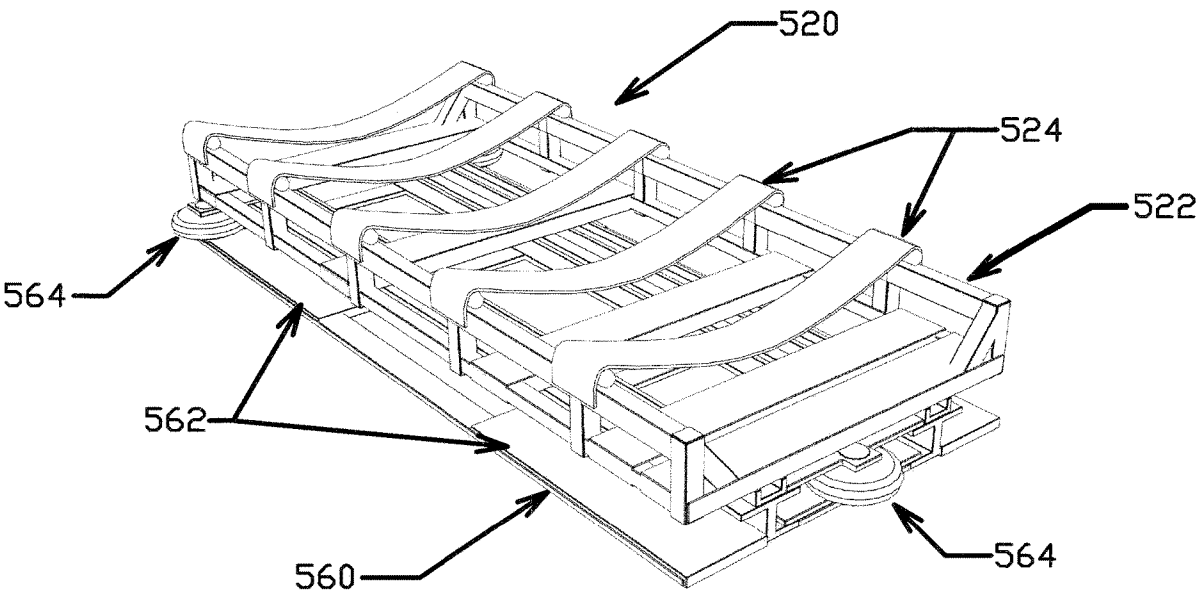
FIG. 14 shows a carrier and air sled according to an example.

In another example as shown in FIGS. 13-23, similar to the prior example, a storage facility and system is generally shown at 500 in FIG. 13, which may include a plurality of docking slips 502 into which watercraft 510 may be positioned. A plurality of doors or openings 505 may be provided in facility 500. The position in the docking slip may be considered a station, with the watercraft 510 then moved between additional stations to a storage position, or from a storage position via a number of stations. One or more of the slips 502 may be provided with a lift system 504 to raise and lower the watercraft 510 positioned therein to or from the water. The lift system 504 may be a hydraulic, computer-controlled system onto which a carrier or support member 520 is positioned for carrying a watercraft 510 between stations as will be described. The carrier 520 may be a customized carrier or other suitable carrier to provide support of the watercraft as it is moved between stations to and/or from the storage facility 500, as shown in more detail in FIG. 14. The carrier member 520 as shown may include a frame 522 with a plurality of adjustable straps 524 to fully support and cradle the hull of any watercraft 510. The carrier 520 may further include a plurality of wheels or the like (not shown) on its bottom, to mate with rails associated with different stations, and to an air sled 560, or the like at a storage position as will be described. The center bottom portion of the carrier 520 is adapted to allow ingress and egress of a tug system as will be described. The system 520 may be positioned on the lift 504 to allow positioning of a watercraft 510 thereon, or alternatively a watercraft 510 may be lifted and positioned on the carrier system 520 in another manner if desired.

Figure 15:
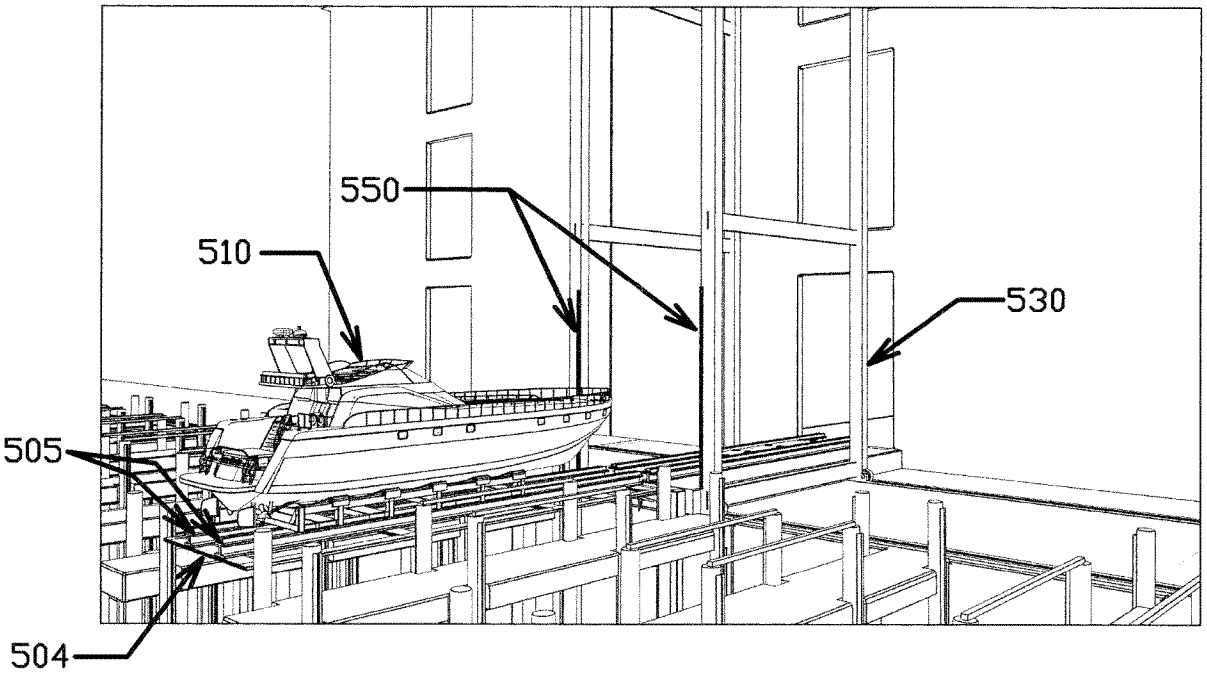
FIG. 15 shows a perspective view of a watercraft on a lift associated with the system according to an example.
Figure 16:
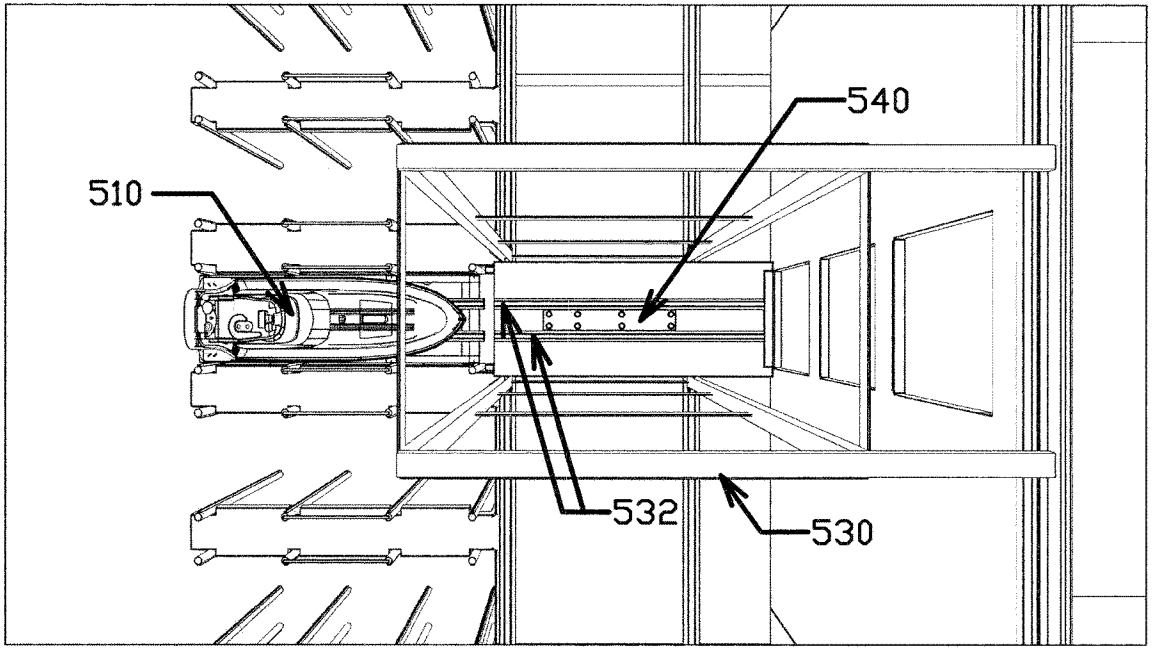
FIG. 16 shows a top view of the elevator system and tug system according to an example.
Figure 17:
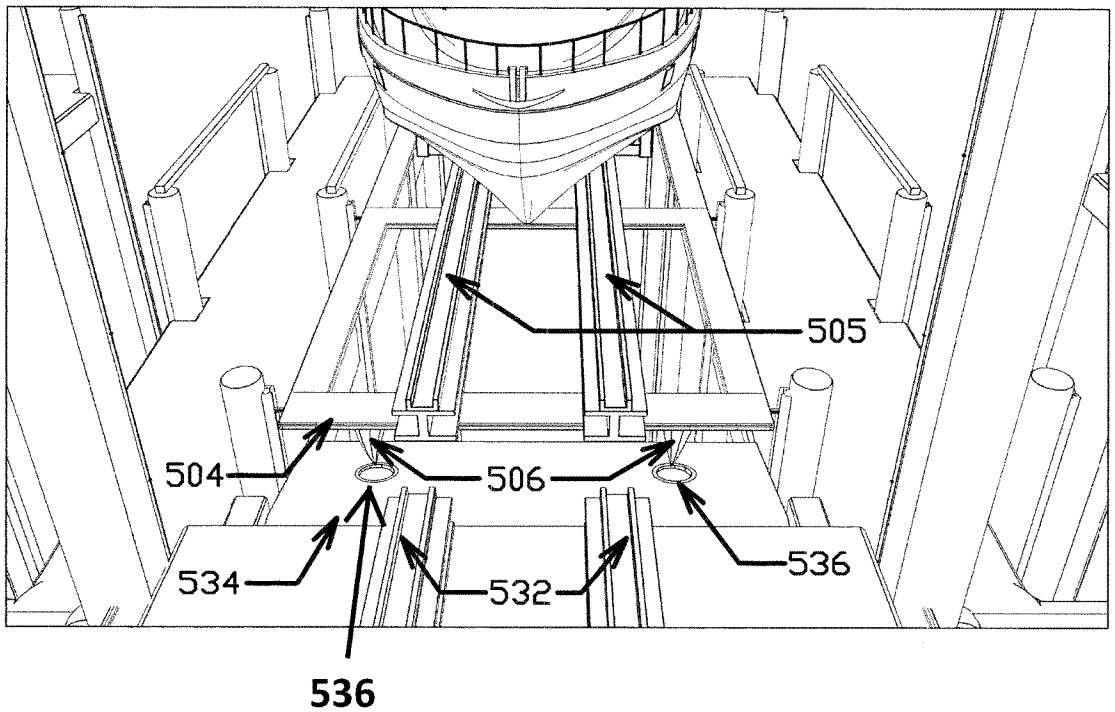
FIG. 17 shows a partial view of the mating the lift system and the elevator system according to an example.

Once positioned on the carrier 520 in a lift 504, the lift 504 may position the watercraft 510 and carrier 520 adjacent a first floor of facility 500 or another position as may be desired. In the example shown, as seen in FIGS. 15 and 16, the lift system 504 raises the watercraft 510 to a position adjacent an elevator system 530 positioned on the exterior (or interior) of facility 500. A tug system 540 is provided to move the watercraft 510 and carrier system 520 from the lift system 504 into the elevator system 530. As seen in FIG. 17, the lift system 504 may include rails 505, which upon being lifted, mate with similar rails 532 associated with the elevator 530. The lift system 504 may have interlock members 506 on the side adjacent the elevator system 530, and the elevator system 530 may have a securing plate member 534 which is moved into an interlocking position with interlock members 506. The interlock members 506 may be male type extensions, and in the example shown, are tapered and curved members formed as fang-like members that engage holes 536 formed in plate member 534 to positively position the lift system 504 in a desired position relative to the elevator system 530. The interlock members 506 in association with receivers 536 rigidize the movement of the carrier system 520 and watercraft 510 from the lift system 504 to the elevator 530 or other transport mechanisms or stations in movement of the watercraft to or from the facility 500 as may be desired, and allow for rapid travel transfers between stations. Other suitable forms of positive engagement and positioning of the lift system 504 (or other systems) relative to the elevator system 530 or the like are contemplated. Further, the watercraft 510 and carrier 520 may be positioned on a ground transporter to allow "yard" movement of the watercraft 510 and carrier or cassette 520 to storage, maintenance and/or repair areas.

Figure 18:
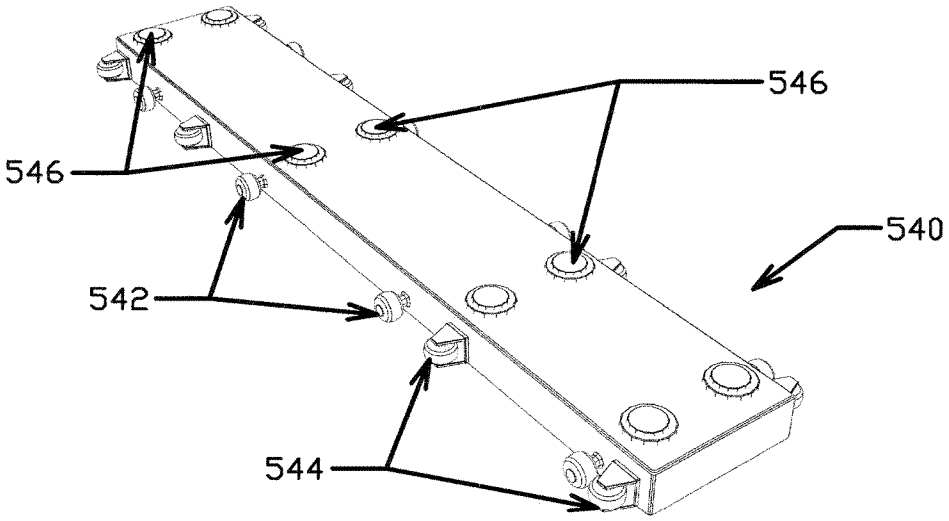
FIG. 18 shows a view of a tug system according to an example.

The tug system 540 is selectively moved from a "home" position in association with the elevator 530 into a position beneath the carrier system 520. The tug system 540 is shown in FIG. 18, may include a plurality of drive members 542 and alignment members 544 on its sides to engage and drive the tug system 540 in association with rails 532 and 505, and other rail systems as will be described. The tug system may also include lifting members 546, which may be piston type members, that are selectively extended into engagement with the carrier system 520 to support it apart from the lift system 504 (or other systems as will be described). Upon being supported on the tug system 540, the carrier 520 and watercraft 510 can be moved between stations in the system in a desired manner. In moving the watercraft 510 from the water to the facility 500, the tug system 540 may initially move the watercraft 510 from the lift system 504 to the elevator system 530. As the watercraft 510 is moved, it may be moved through an omni-directional washing system 550 (FIG. 15) to clean the exterior surfaces of the watercraft before being stored in facility 500. The wash down water can be recycled to make the system ecofriendly. The tug system 540 moves the carrier 520 and watercraft 510 into position on the elevator 530 for subsequent movement into a desired storage position in facility 500. The tug system 540 is selectively moved between stations by the drive members 542 which engage the interior of rails 505 and 532 at these stations, and other rails as will be described. In moving the watercraft 510 and carrier 520, the tug system may be configured to support the weight and dimensions of watercraft 510, and additional drive members 542, alignment members and/or lift members 546 may be used if desired. Other suitable configurations of the tug system 540 may also be used.

Figure 19:
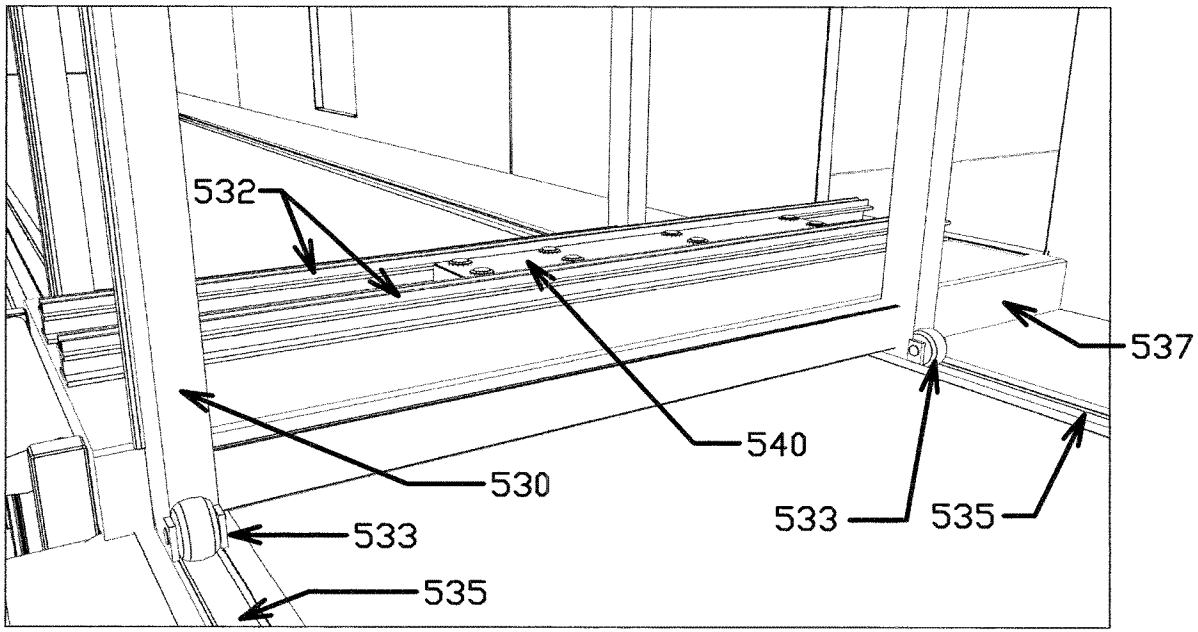
FIG. 19 shows a partial view of the elevator system and tug system according to an example.
Figure 20:
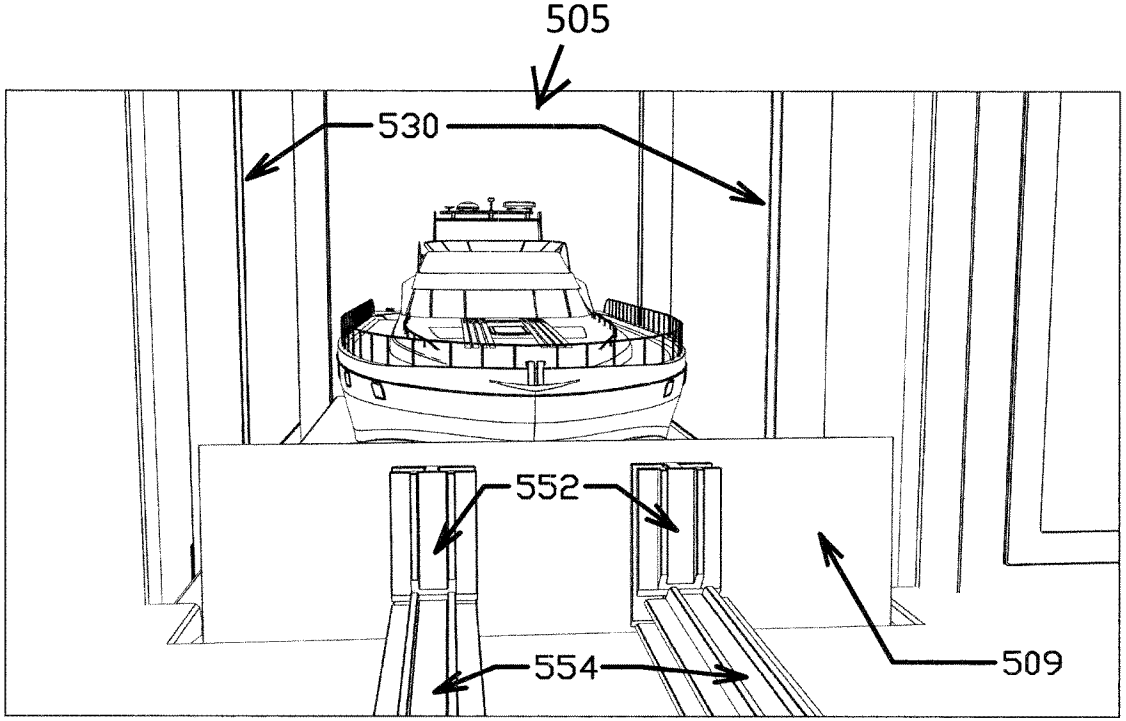
FIG. 20 shows a watercraft positioned on the elevator system adjacent an opening in the storage facility according to an example.
Figure 21:
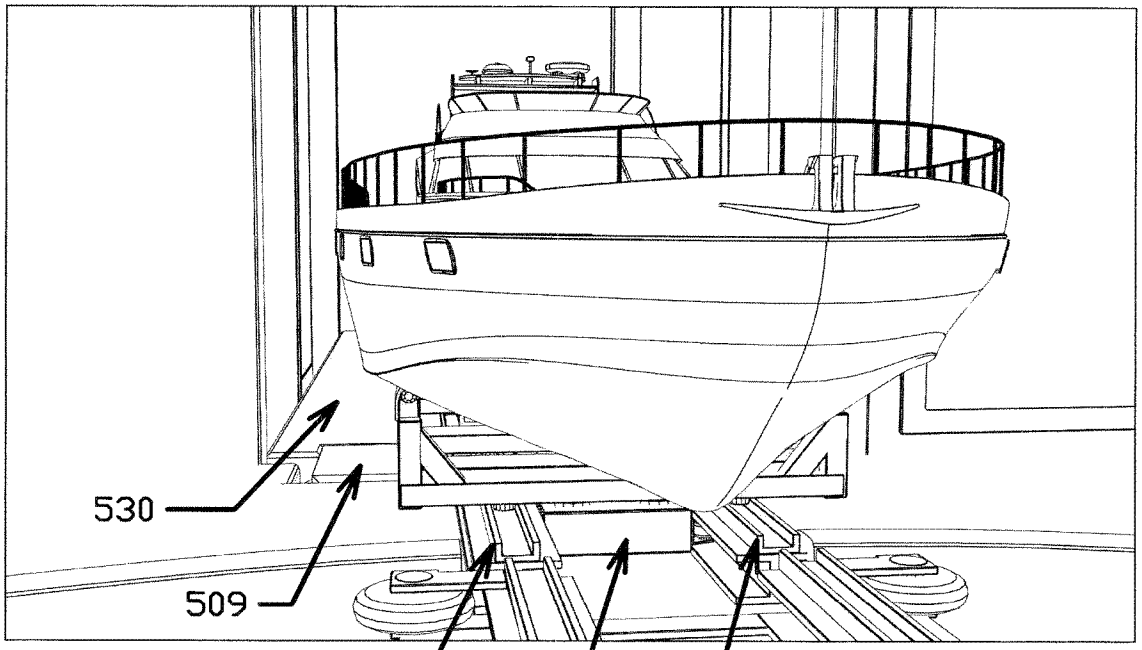
FIG. 21 shows the movement of the watercraft from the elevator system into the facility according to an example.
Figure 22:
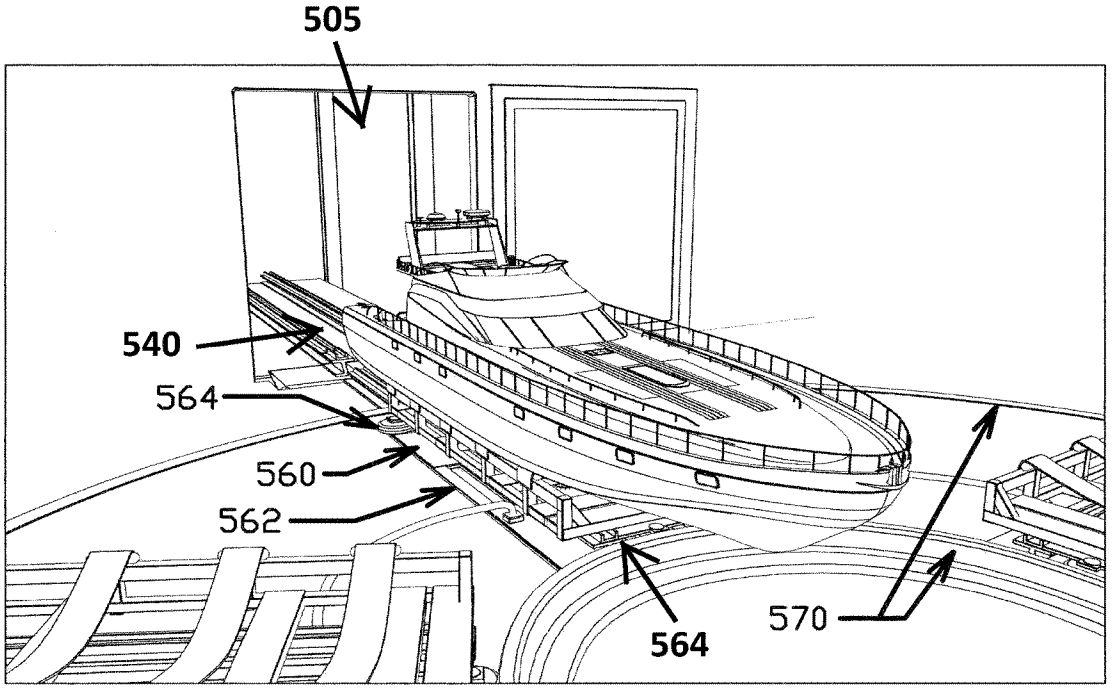
FIG. 22 shows positioning of the watercraft on an air sled in the facility according to an example.
Figure 23:
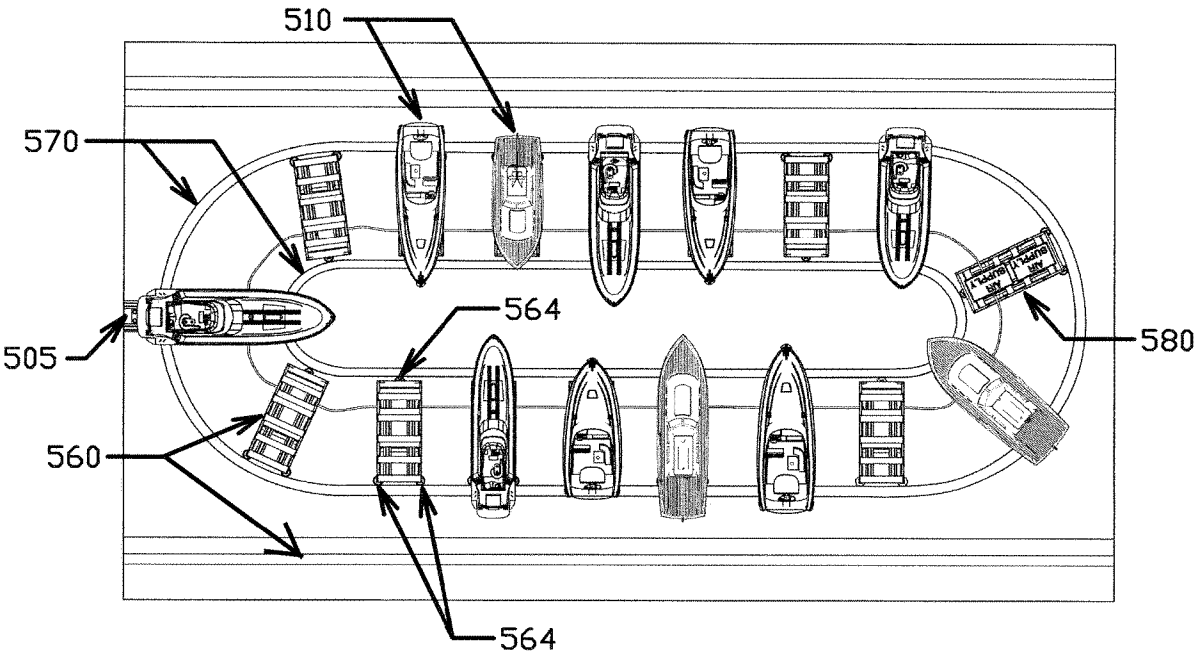
FIG. 23 shows a top view of watercraft stored in the facility according to an example.

As shown in FIG. 19, the elevator system 530 may have wheels 533 that allow movement within a track system 535. The elevator system 530 may thus be moved to any desired location exterior or interior of the facility 500, to position watercraft at a desired position. A lift platform 537 is driven vertically (if needed) within a frame system 538 to lift the watercraft 510 and carrier 520 on the tug system 540 to or from a desired storage position in facility 500 as needed. The elevator system may use a lifting system incorporating a rigid chain lift, such as produced by Serapid, Inc., or other suitable systems. Upon being positioned adjacent a predetermined floor or location in facility 500 as shown in FIGS. 20-22, the tug system may then move the watercraft 510 and associated carrier 520 from a station on the elevator 530 to a storage station. As shown in this example, the facility 500 may have a plurality of openings 505 through which watercraft 510 may be moved into or from the facility 500. A barrier 509 adjacent the opening 505 on each floor may be selectively moved to mate with the elevator system 530 via rails 552, which also mate with rails 554 positioned on a floor inside facility 500. As seen in FIGS. 21 and 22, the tug system 540 may then move the watercraft 510 and associated carrier 520 onto an air sled 560 or other suitable system for storage in facility 500. In this example, the facility 500 is arranged to store watercraft 510 on a plurality of floors in a circular or oval configuration for example, with a plurality of watercraft 510 moved in a carousel type fashion. As shown in FIG. 23, as an example, on a floor of facility 500, a guide track system 570 and a plurality of air sleds 560 are provided, such that a plurality of watercraft 510 may be positioned on the air sleds 560 and selectively moved around guide track system 570. Each of the air sleds 560 may be positioned at the location of the building opening(s) 505, for storage or removal of a watercraft therefrom. The tug system 540 can move the watercraft 510 and associated carrier 520 to or from an air sled 560 via rails between these stations and associated with the air sled 560, along with wheels on carrier 520 that mate with the rail system. To allow movement of each of the air sleds 560, air bearings 562 may be used on each corner thereof, or any other suitable system to allow movement of sleds 560 may be used. A system 580 (FIG. 23) for supplying air may be provided at a position in the carousel arrangement or in another position if desired. To facilitate movement of the system of sleds 560, each may include one of more drive members 564 (FIGS. 14 and 23 for example) that interface with guide track system 570, providing each sled 560 with a drive system, which can then work in conjunction with one another to move the entire system as needed to position any sled 560 adjacent the opening 505 to accept or remove a watercraft and carrier therefrom. It should also be understood that any other suitable drive system for the sled systems 560 may be used. Further, the use of any other suitable tram or conveyor type system for supporting and moving the stored watercraft 510 is contemplated.

As mentioned above, it may be desired to provide watercraft operational systems in association with the stored watercraft 510. The carrier 520 may have an electric supply system and/or a water circulation system for example, to interface with the sled 560, the guide track 570 or the like. Suitable interface allows electric and water circulation connection systems to supply the operational systems of the watercraft 510. For example, the guide track 570 may have a power supply raceway (not shown) to which an electric connection associated with the carrier 520 and/or sled 560 is interfaced, and/or plumbing lines to supply water circulation systems. As the sleds 560 move along the guide track 570, the electrical and plumbing connections may thus allow electric power and water circulation to be supplied to the watercraft 510, regardless of its position in the carousel-type arrangement. Other operational systems may be supplied to the watercraft when stored, at their location on the carousel. Fire suppression systems may also be provided to suppress fire in any watercraft stored along the carousel.

In this example, the movement of the carrier 520 and watercraft 510 via the lift system and the tug system 540 may be computer controlled. Further, in operation, a facility may have additional lifting and/or positioning systems in or outside of the facility to handle the watercraft loading and unloading to and from storage. The watercraft is positioned in association with its carrier 130, and may then be moved via the tug system 540 as described and/or additional positioning systems. In operation, storage or retrieval of a watercraft or other item can be performed very quickly and effectively.

Figure 24:
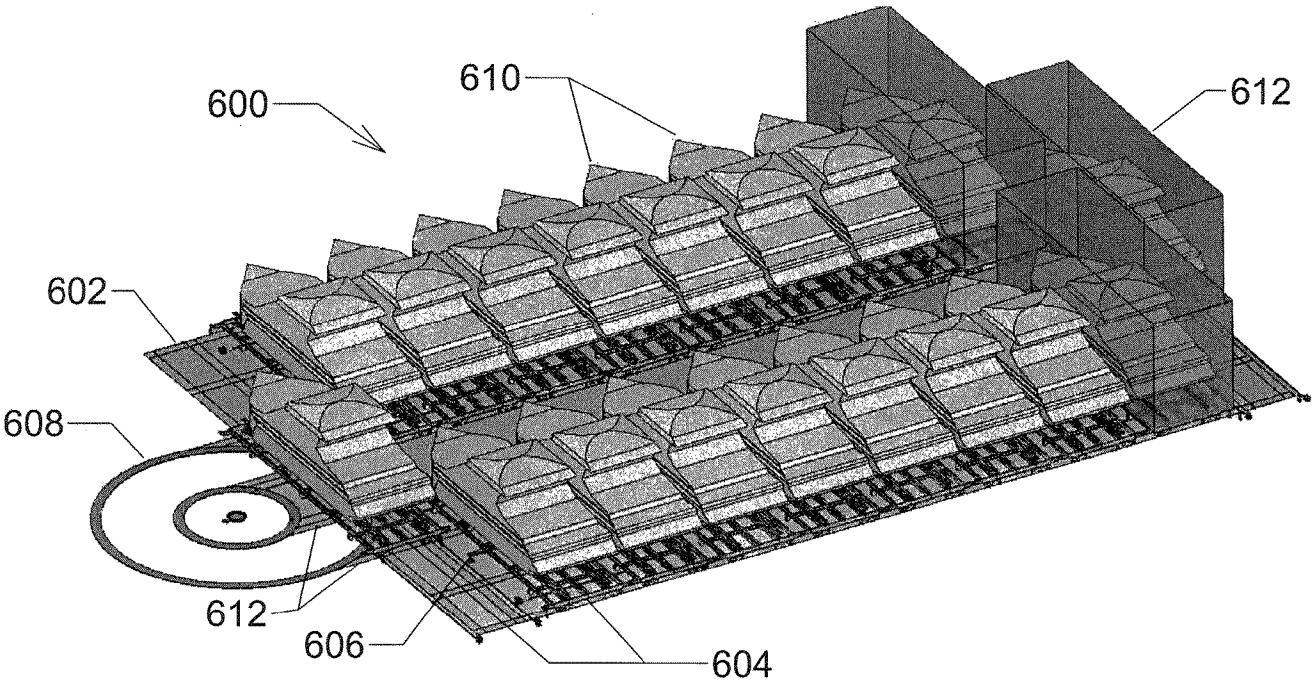
FIG. 24 shows an alternate example of a storage system according to the invention.

In another example as shown in FIG. 24, a storage facility and system is generally shown at 600, which may include a plurality of floors having a plurality of storage systems for watercraft 610 (or other items such as shipping containers 612) formed in a carousel type configuration. In this example, a framework 602 supports a plurality of carriers 604, which in turn support the watercraft 610 or other items. The carriers 604 are movable on the framework by wheels, air bearings or other suitable arrangements, and are indexed around the framework 602 by a suitable drive system 606, such as a chain drive mechanism as may be used in pulling roller coasters up inclines, a push/pull chain drive system or other drive systems for example. Drive or push/pull systems such as produced by Serapid, Inc. may be suitable. Other suitable drive systems may be used. A turntable tug rail system 608 may be used to interface with the storage facility 600, which may allow positioning of a watercraft or the like on a carrier 604 exterior to the framework 602 and then moved into position via rails 612 or the like. The turntable 608 allows reorientation of the watercraft 610 or the like to a desired position.

Figure 25:
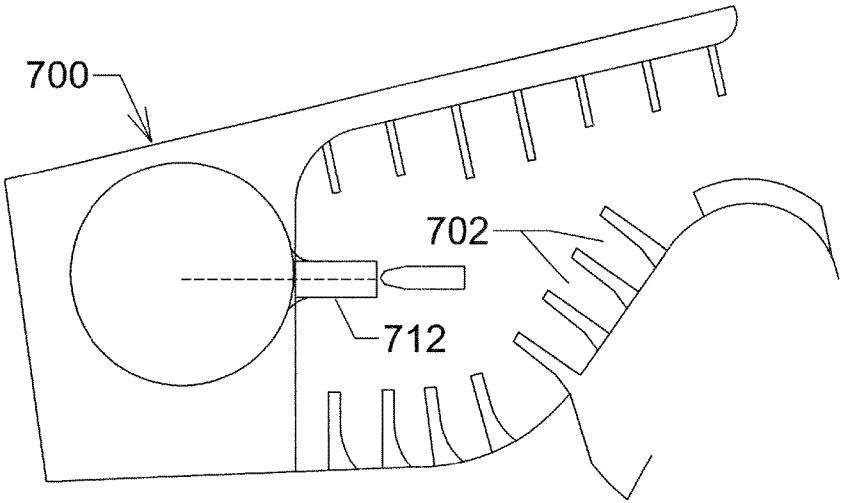
FIGS. 25-27 show an alternate example of a storage system according to the invention.
Figure 26:
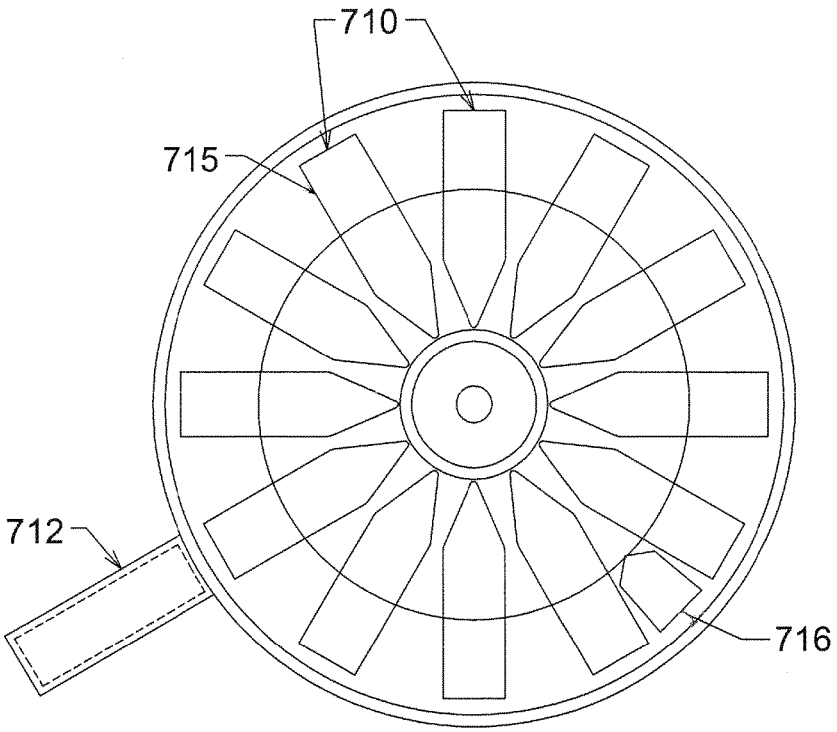
Figure 27:
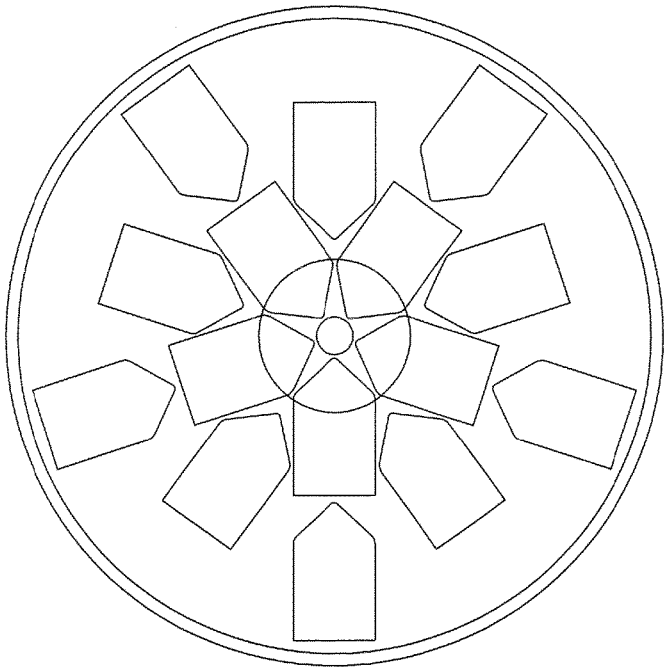

In another example, as shown in FIGS. 25-27, a storage system 700 for a plurality of watercraft 710 or the like may be configured as a circular structure. A plurality of docking slips 702 may be provided adjacent facility 700, which allow a staged transition to or from storage, where a user may drop a boat off in a slip 702 and then the boat can subsequently be put into the storage facility 700. Watercraft may be selectively stored and/or removed from facility 700 at a fixed lift station 712 for example. Other suitable systems to lift and/or position a watercraft 710 into facility 700 are contemplated, such as described in other examples. In this example, once the watercraft is lifted at station 712, it may be moved into facility 700 as seen in FIG. 26, by a tug system, chain push/pull system or other suitable system as described in other examples. The lifting of craft or the like may be via an elevator type arrangement, a lifting frame system, hoist system or other suitable system. In this example, the watercraft 710 are supported on a carousel arrangement such as previously described and movable in a circular motion within facility 700 until an open position is located adjacent the station 712. The arrangement allows for close packing of various size watercraft 710, such as larger craft 715, and provides space for personal watercraft (jet skis, etc.) 716 or other items between crafts or items stored on radius lines from the center of the circular configuration for example. Such as system may be suitable for larger craft along radius lines for example, or may allow multiple craft to positioned along a radius of the circular configuration such as shown in FIG. 27. The systems for lifting and moving the craft or other items may be similar to other examples or other suitable arrangements.

Another example is shown in FIGS. 28-44, wherein a storage facility 800 is provided with a plurality of berths 802, which may of different sizes to accommodate different watercraft 810 or other items. The facility 800 may have two or more stacks or structures 804 and 806, with berths 802, which are separated from one another. A traveling elevator system 820 may be positioned between the stacks 804 and 806, and is adapted to move along the length of the stacks 804 and 806 to position a watercraft 810 in any desired berth in either stack 804 and 806 for example. There may also be one or more turntable positioning units 880 provided for positioning of watercraft (or otherwise) in berths 802, and such a turntable positioning arrangement may also be used in association with the elevator system 820 if desired.

Figure 29:
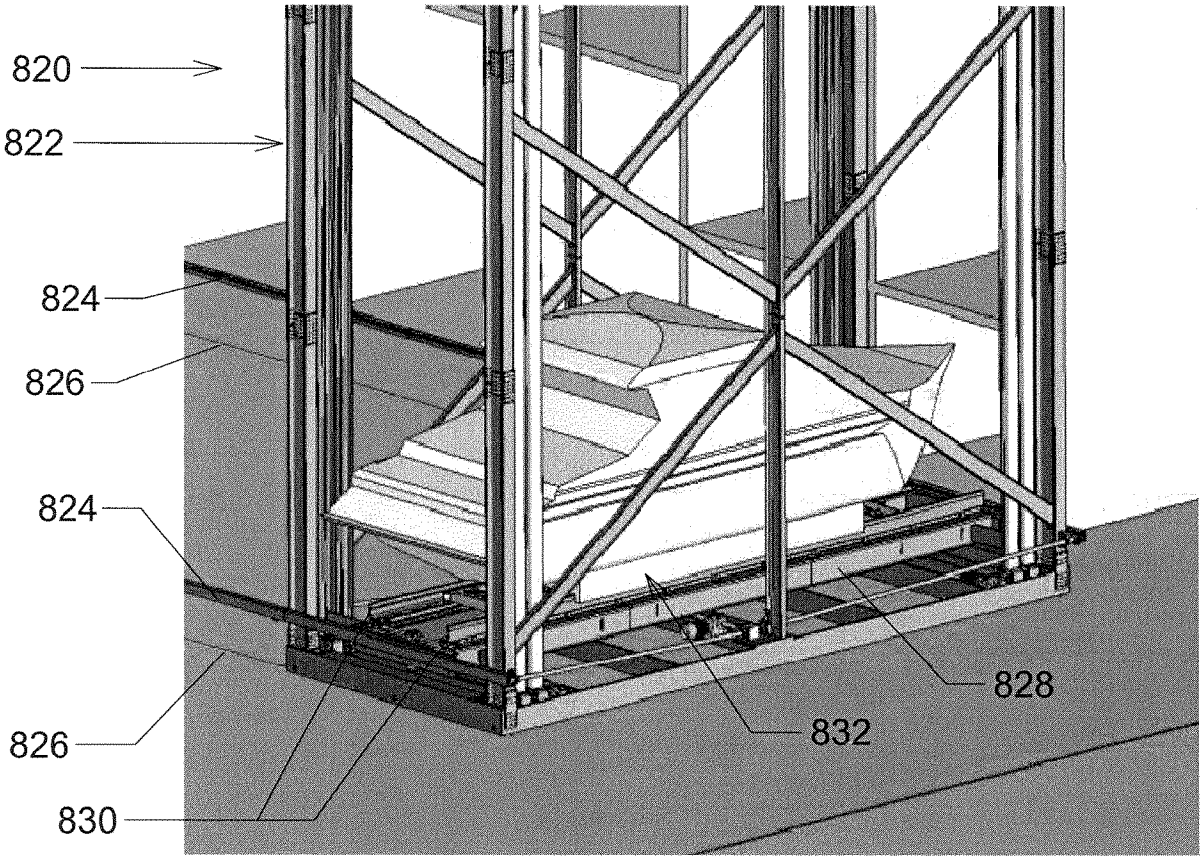
FIG. 29 shows a partial view of elevator system according to an example.
Figure 29A:
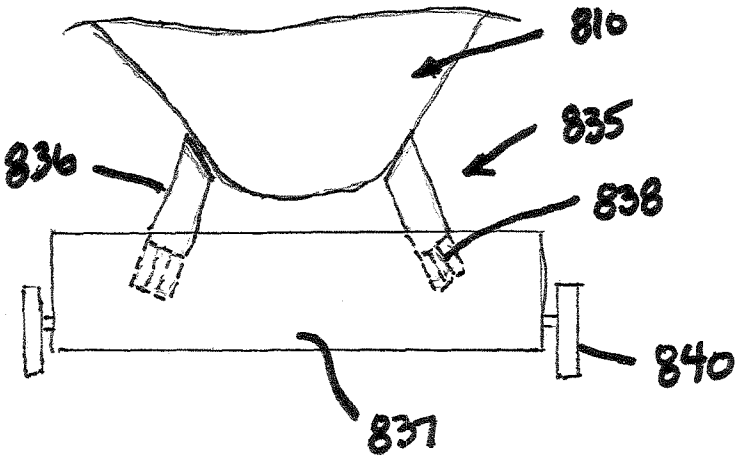
FIG. 29A shows a schematic end view of an alternate tug and bunk arrangement for supporting a craft.

As seen in FIG. 29, the elevator system 820 may include a tower 822 associated with a lateral drive guide system 824, such as one or more pairs of drive guide rails 824, that allows the elevator tower 822 to move laterally along the stacks 804 and 806 in association with floor rails 826. The elevator system 820 further has a lift platform 828 that is selectively moved up and down in the tower 822. Situated on platform 828 may be guide rails 830, which accept and support a push/pull tug 832 with carrier or cassette 833 on which a watercraft 810 is positioned and supported. The carrier or cassette 832 may be customized for the watercraft 810 or adapt to its configuration. Alternatively, a bunk system 835, as shown in FIG. 29A, could be provided to carry and support different watercraft 810, wherein the bunk system 835 may have universal supports 836 extending from a tug system 837 to support the hull of watercraft 810. The supports 836 may have hydraulic cylinders 838 associated therewith, that allow for variable extension of the supports 836 and allow for some flexibility in supporting the watercraft 810. Each of the carrier or cassette 832 or bunk system 835, are associated with a tug system that allows movement of the watercraft 810 (or other item) both into a berth 802 from the elevator system 820 or from a berth 802 onto the elevator system 820. The tug systems 832 or 837 may include flanged wheels 840 which mate with the tug guide rails 830, and allow the system to be moved onto or off of the elevator lift platform 828. The tug system 832 and/or 837 may also provide for electrical and/or plumbing connections to the watercraft 810 if desired, such as described in other examples.

Figure 30:
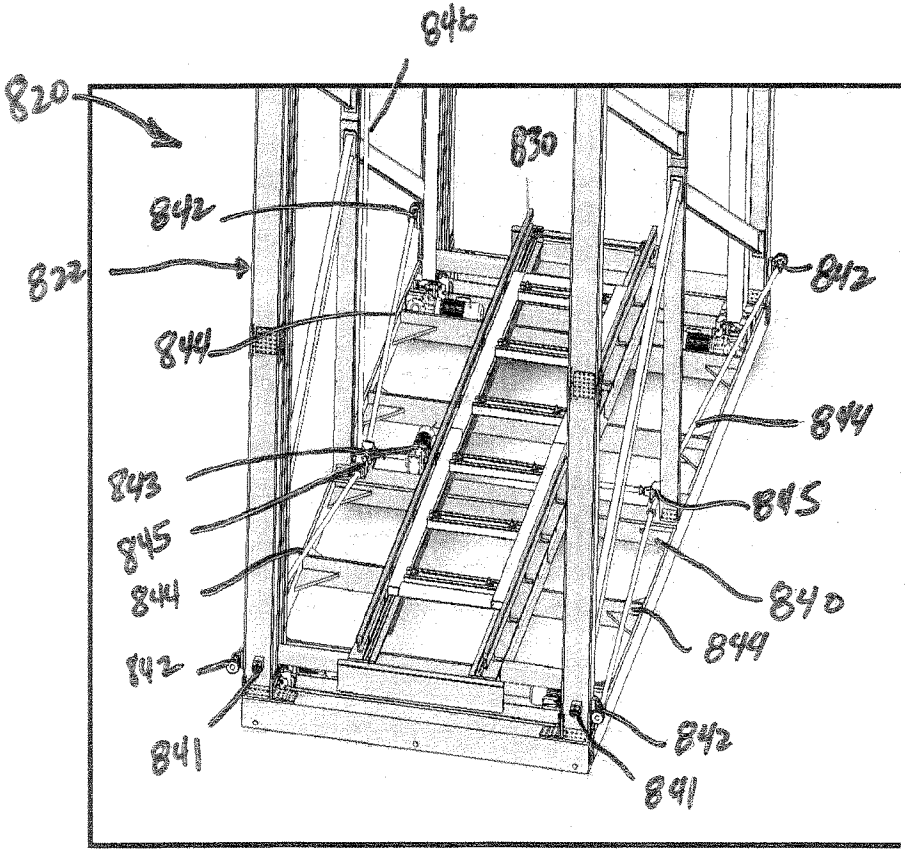
FIG. 30 shows a partial view of the elevator system as shown in FIG. 29.
Figure 31:
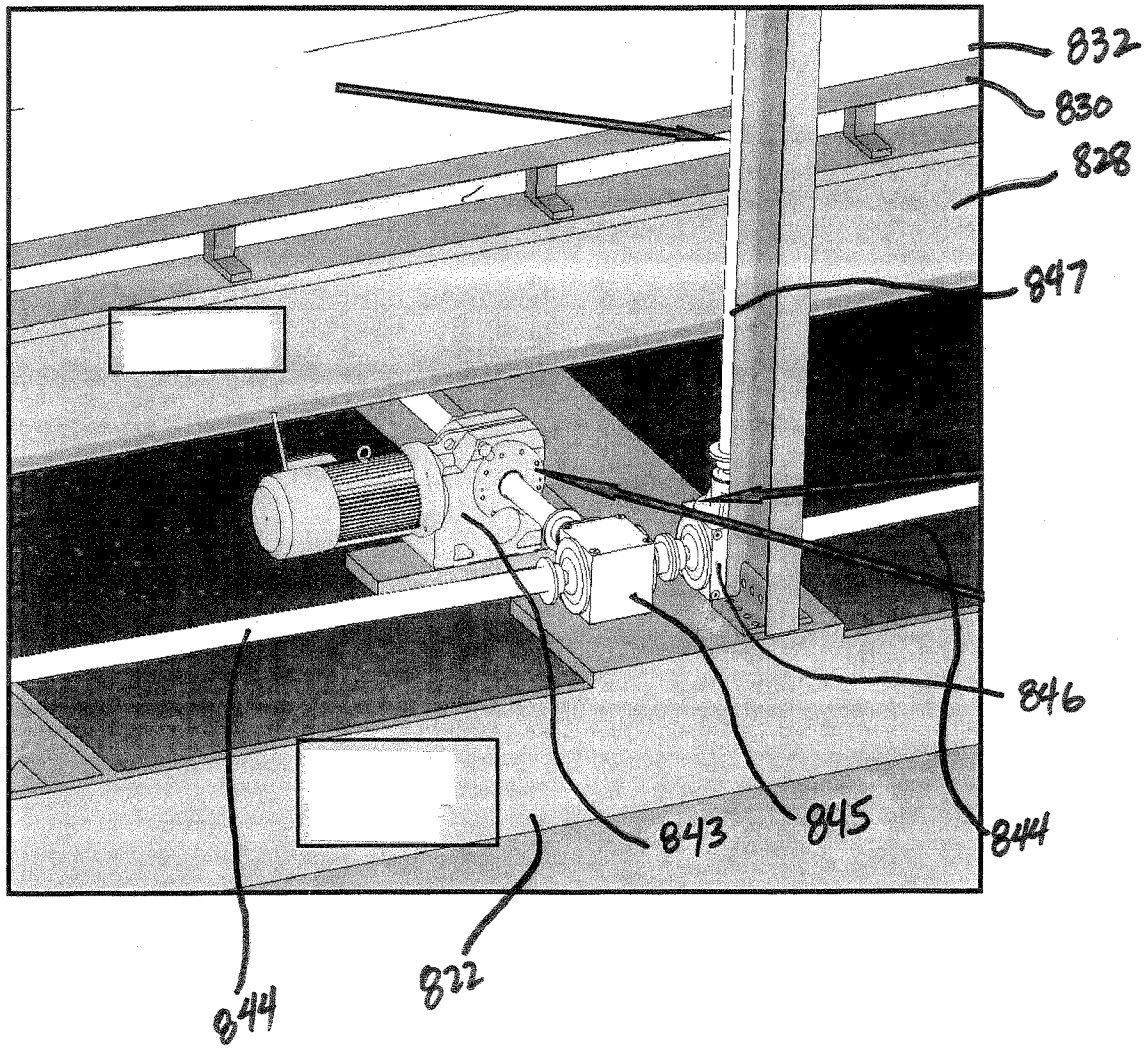
FIG. 31 shows a partial view of an elevator drive system according to an example.
Figure 32:
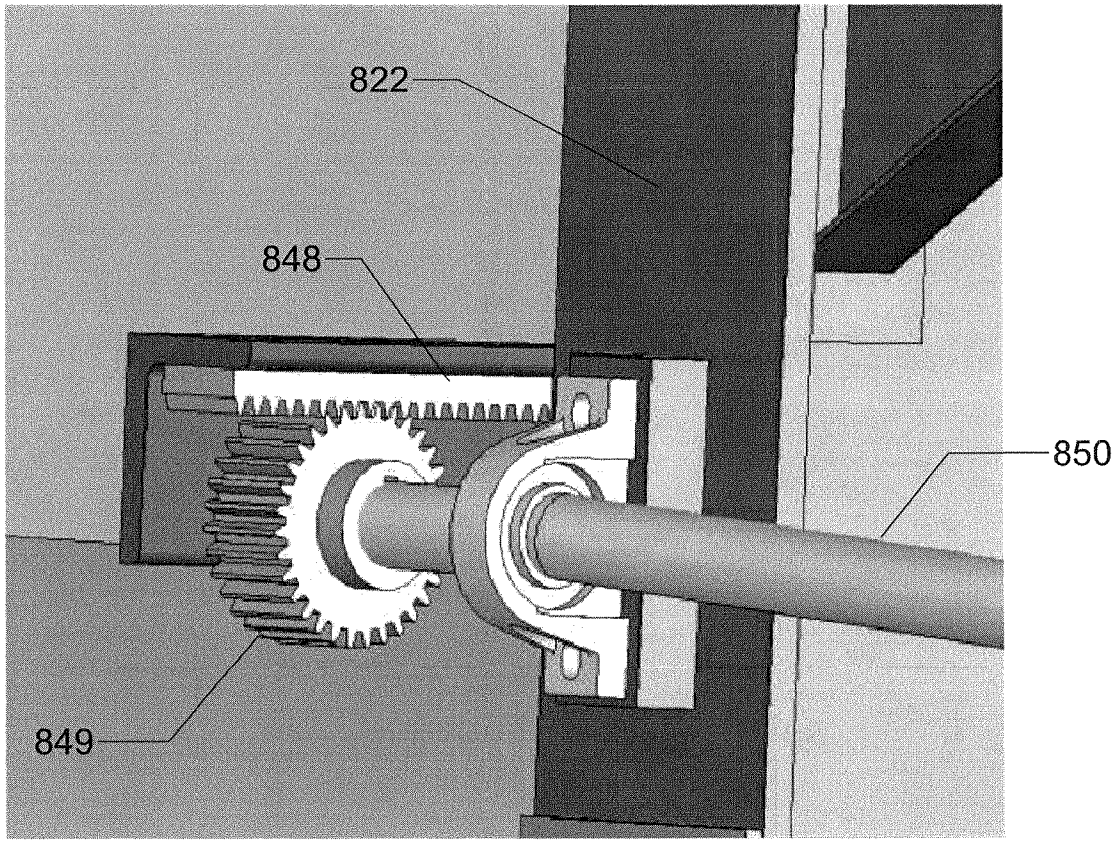
FIG. 32 shows a partial view of the elevator drive system according to an example.
Figure 33:
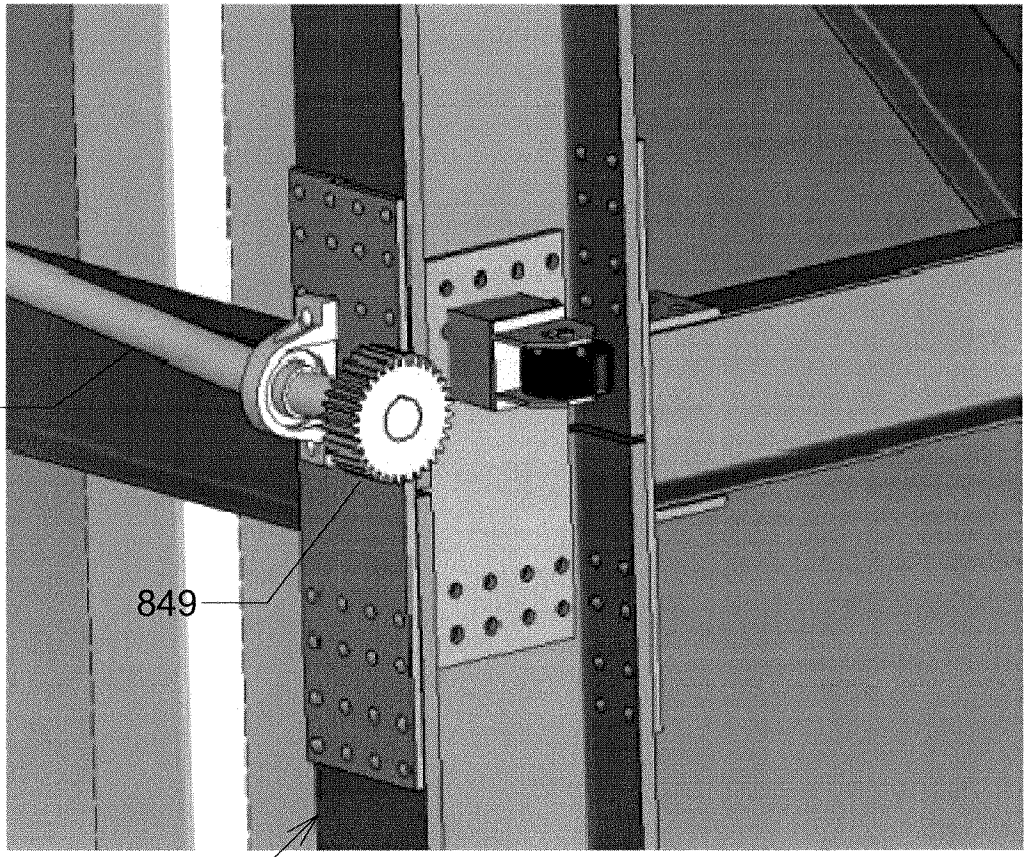
FIG. 33 shows a partial view of a mid-level or upper level elevator drive system according to an example.
Figure 34:
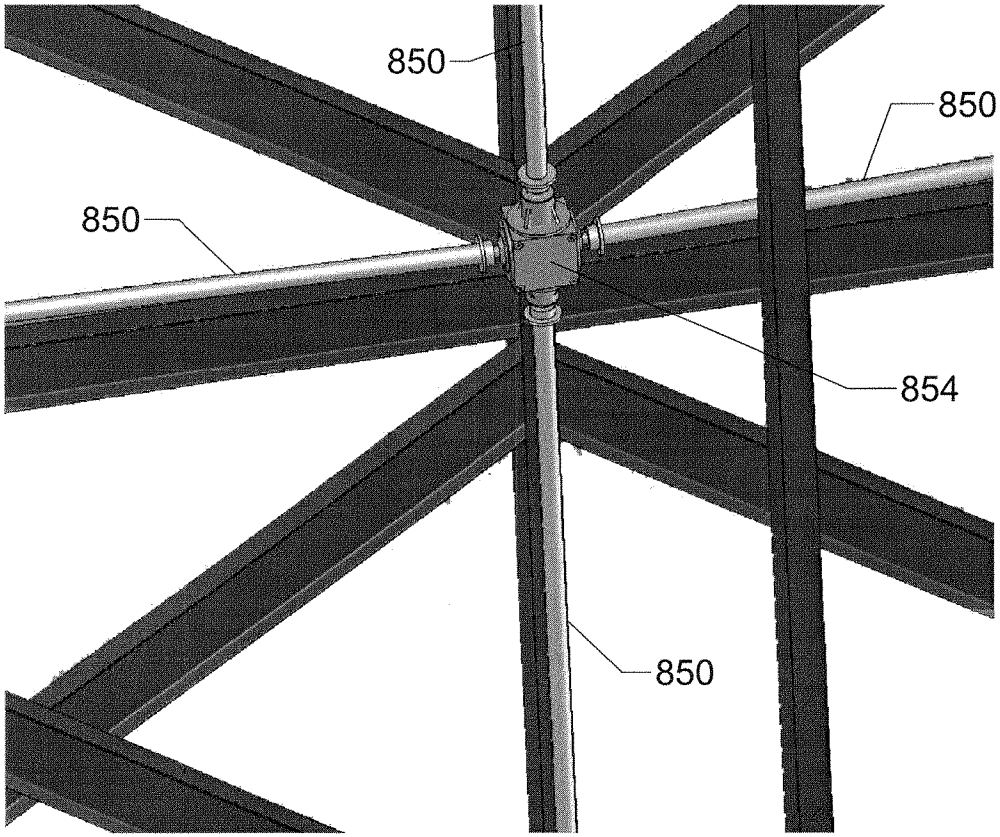
FIG. 34 shows a partial view of a mid-level or upper level elevator drive system according to an example.

As seen in FIGS. 30 and 31, the elevator system 820 may include a drive system 840 for cooperating with the lateral drive guides 824. The drive system may include a plurality of drive members 842 that cooperate with the drive guides 824. For example, the drive members 842 may be geared wheels and the guides 824 may be a gear track, but other suitable systems are contemplated. There may also be provided a plurality of guide wheels 841 that engage the stacks 804 and 806 and maintain the tower 822 in a centered position therebetween. The drive members 842 may be driven by a motor 843 coupled to each of the drive members via linkage arms 844 and associated transfer case systems 845. Alternatively, separate motors may be used to drive each of or several of the drive members 842 if desired. The drive members are actuated in a synchronized fashion, such as by use of the single motor 843 and synchronization transfer cases 845, which translate output drive from the motor 843 to each of the drive members 842 in a synchronized fashion. Alternatively, several or separate motors may be operated in a synchronized fashion to cause synchronized movement of the drive members 842 via linkage arms 844. If desired, upper portions of the tower 822 may be similarly driven relative to stacks 804 and 806, such as by mid-level and/or upper level drive guide rails 848 (one being shown in FIGS. 32 and 33) in association with additional drive members 849 (one being shown in FIGS. 32 and 33). To allow synchronous driving of mid-level and/or upper level drive members 849, the motor 843 may also be coupled to a synchronization transfer case 846 coupled to synchronously drive a synchronization shaft 847 that feeds drive to a further series of synchronizing transfer cases 854 (FIG. 34) and linkage arms 850 (one being shown in FIGS. 32 and 33) coupled to drive additional drive members 849. As seen in FIG. 34, a upper synchronization shaft 850 may feed drive poser to a further transfer case and linkage arms if desired.

The drive guide rails 848 may be positioned mid-way and/or toward the top of tower 822 to facilitate smooth movement of the tower 822 laterally between stacks 804 and 806. Additional guide wheels 852 may be provided to maintain the tower 822 in a centered position relative to stacks 804 and 806 similar to guide wheels 831. Though additional drive members 849 and associated drive systems may be provided at mid-level and/or upper level locations, they are optional and may not be provided as desired.

Figure 35:
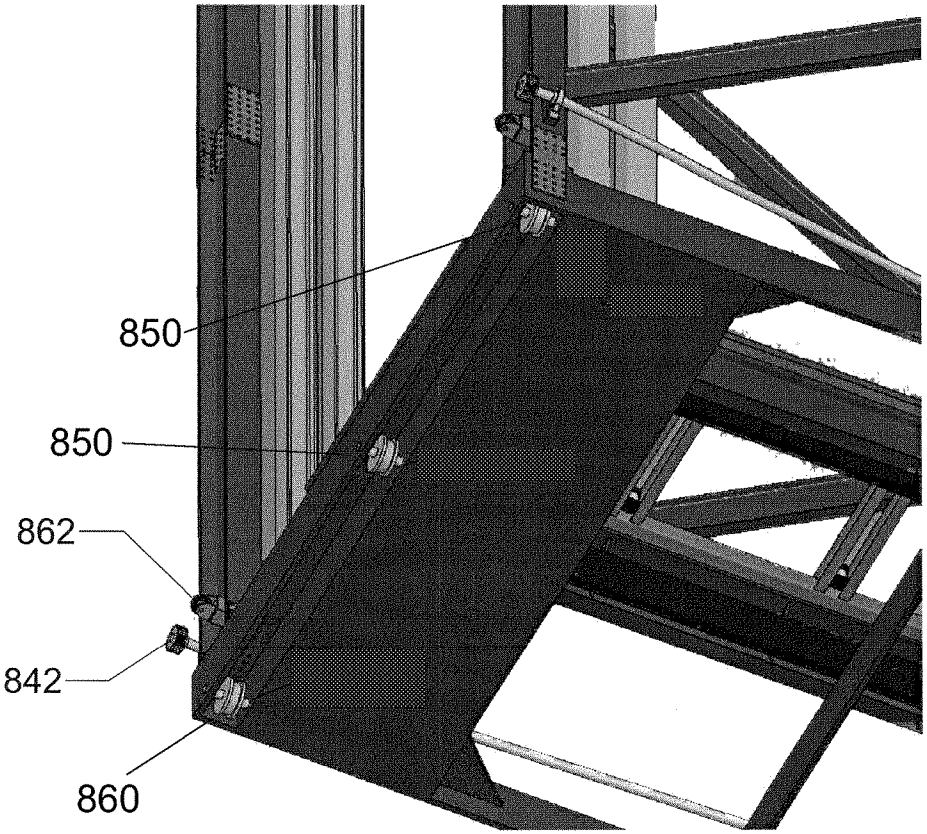
FIG. 35 shows a partial view of a bottom portion of the elevator system according to an example.
Figure 36:
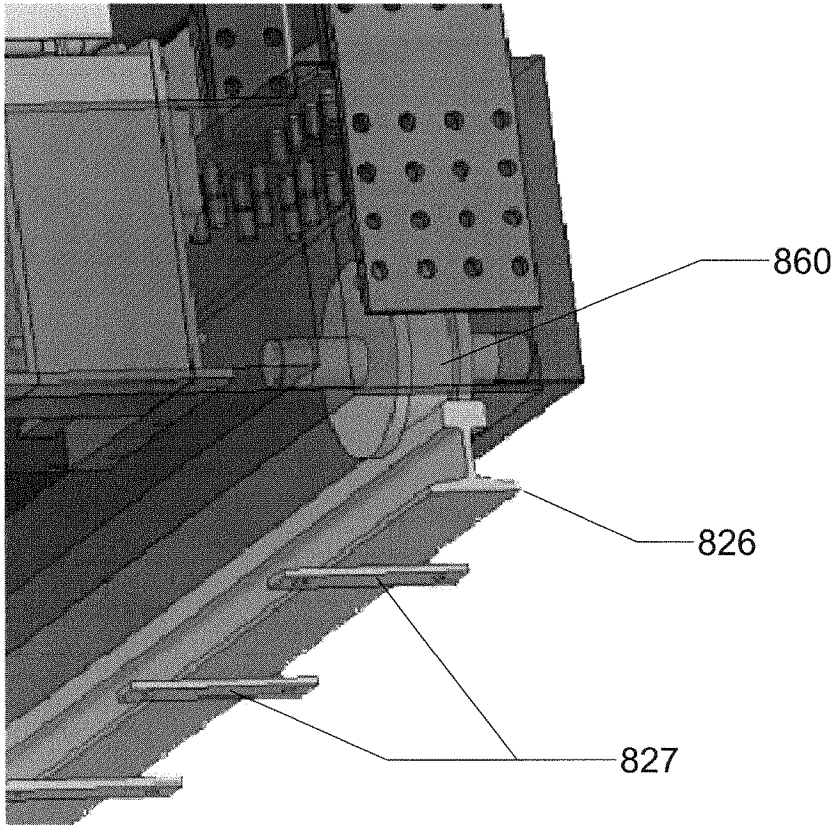
FIG. 36 shows a partial view of a bottom portion of the elevator system according to an example.

As seen in FIGS. 35 and 36, the elevator system 820 may be positioned on guide tracks 826 to allow movement of the tower 822 between the stacks 804 and 806, via the tracks 826. The tracks 826 may be positioned and leveled by rail leveling plates 827. The tracks 826 may extend interior to the stacks 804 and 806 or could be made to allow movement of the tower 822 to the exterior or other locations as may be desired. The tower 822 may be supported on the tracks 826 via flanged load wheels 860 provided on the bottom edges of the tower 822. The load wheels 860 engage and are movable on the tracks 826 to enable lateral movement of the tower 822, upon actuation of the drive members 842.

Figure 37:
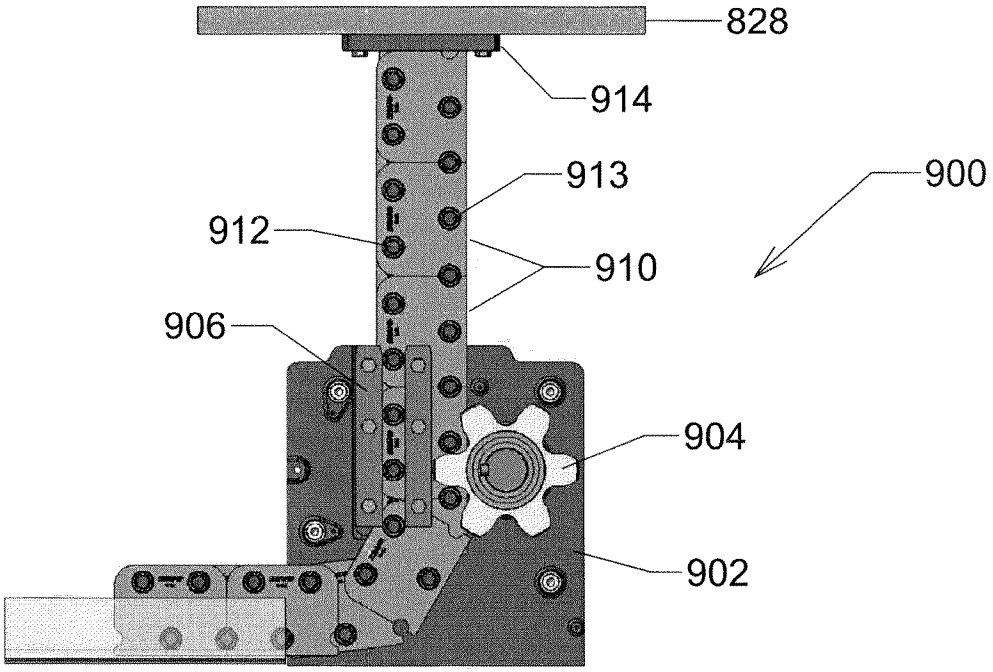
FIGS. 37-40 show views of an elevator lift system according to an example.
Figure 38:
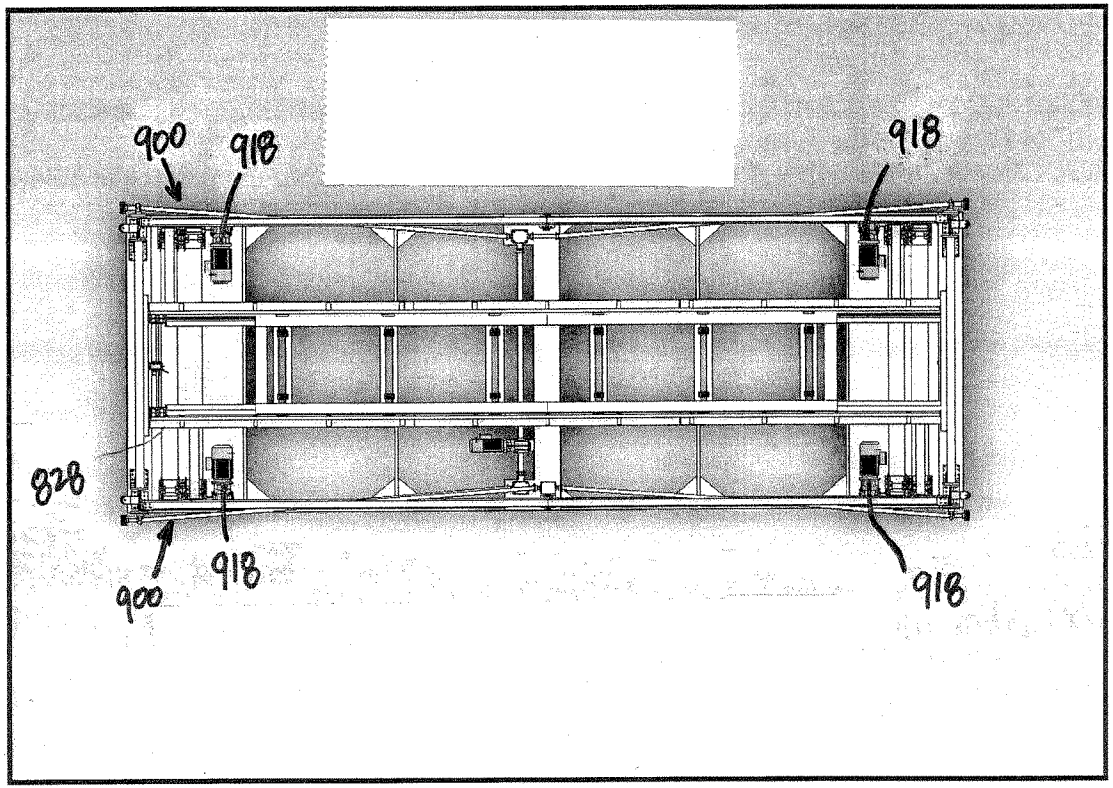
Figure 39:
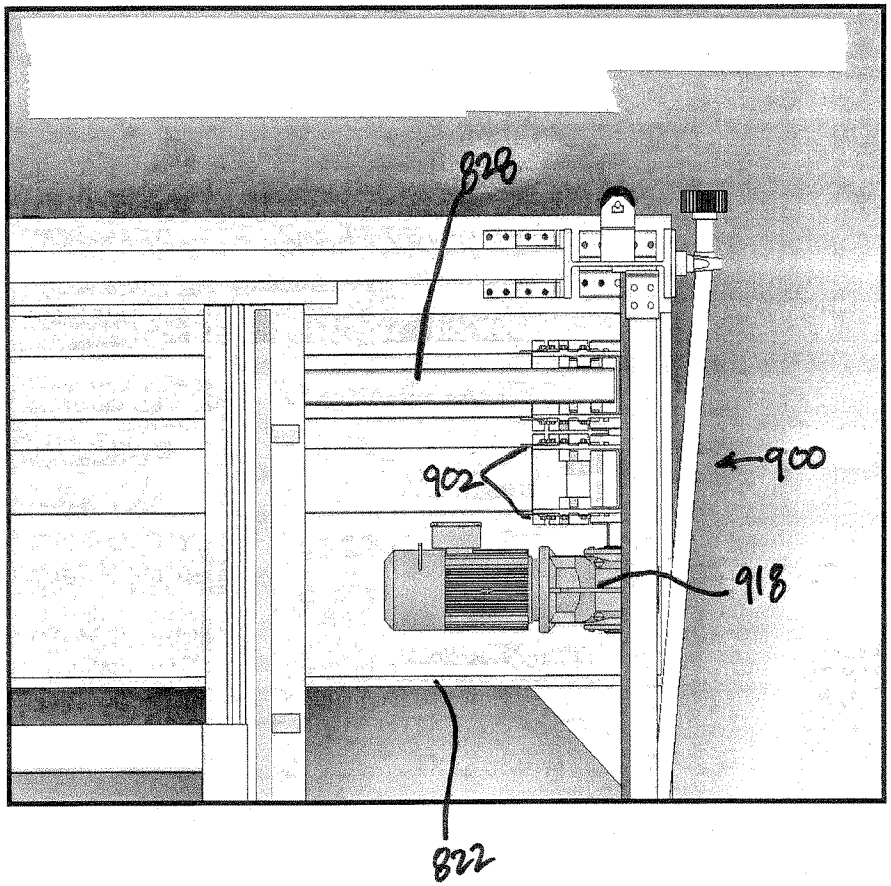
Figure 40:
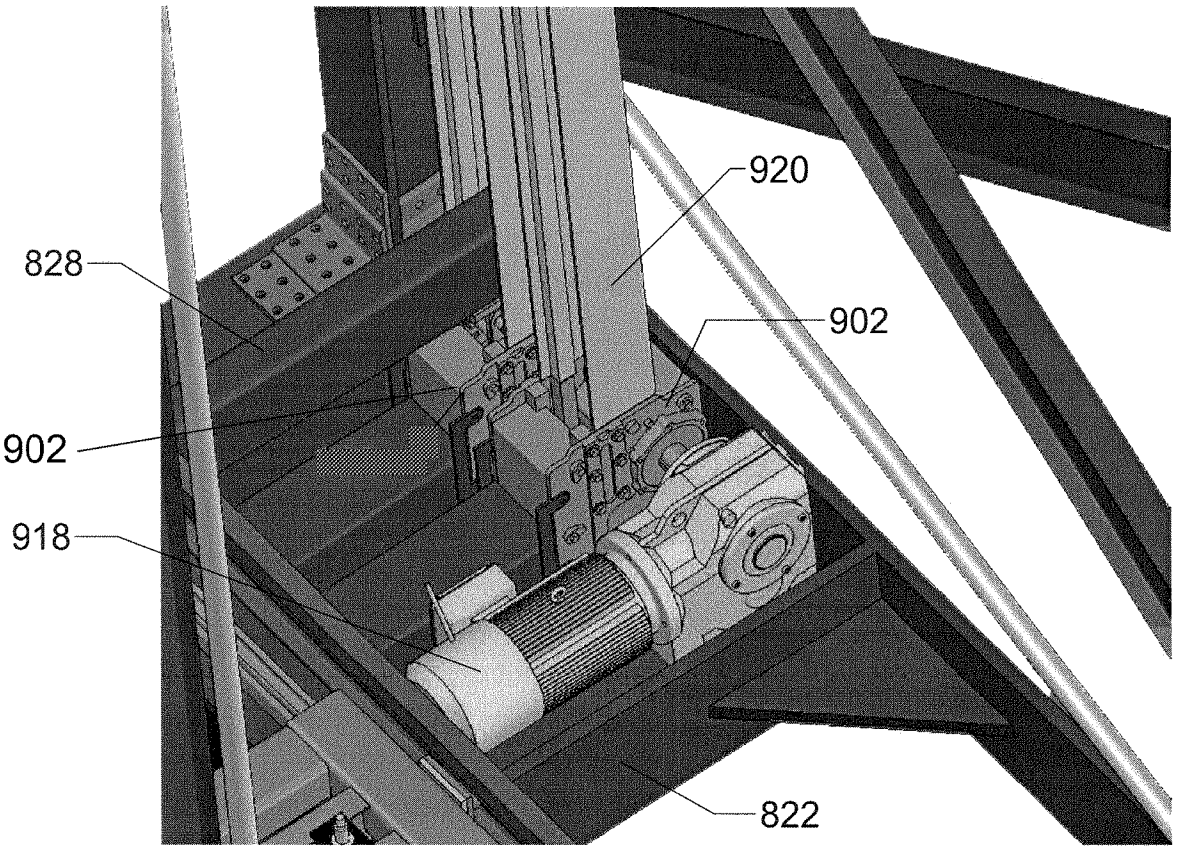

Turning to FIGS. 37-39, a lift system associated with the lift platform 828 may be any suitable type but in the example, may comprise a plurality of rigid chain lift systems, such as produced by Serapid, Inc. For example, a rigid chain lift system such as the Link-Lift 100R systems produced by Serapid may be suitable. Such a system is generally shown at 900 in FIG. 37, and includes a drive housing 902 attached to the base frame of the elevator system tower 822. Mounted in association with the drive housing 902 is a drive sprocket 904 and roller guide 906. A series of rigid chain links 910 have two series of drive rollers 912 and 913 associated therewith which are driven through the drive housing 902 by the drive sprocket 904. The chain links 910 are attached to the lift frame 828 by an attachment link 914. The chain links 910 are driven through the drive housing 902 by rotation of the drive sprocket 904 acting on rollers 913, and roller guide 906 guides at a plurality of rollers 912 from at least two chain links 910. In this way, such as shown in FIG. 37, guide rollers 912 from adjacent links 910 are constrained by the roller guide 906 and create a locking moment between the rollers 912 in the roller guide 906 and the rollers 913 acted on by drive sprocket 904 to lock the adjacent links 910 together as they are driven through the drive housing 902, creating a beam-like assembly that will raise lift frame 828 to a desired height. The system 900 has a chain storage 916 at the bottom, and upon rotating drive sprocket 904 in the opposite direction, pulls the lift frame 828 back down to a ground level position and stores the chain accordingly. As seen in FIG. 38, the lift frame 828 may be raised up and down by four chain drive systems 900, with one at each corner of a base frame 822. Each system 900 includes a drive motor 918, with each motor 918 operated synchronously to simultaneously raise and lower the lift frame 828. As seen in FIGS. 39 and 40, each system 900 may include lift frame 828 supported on each of the chain drives 900 for raising and lowering the lift frame 828 relative to the base frame 822. Upon actuation of motor 918, the chain drive operates to raise and lower the lift frame 828, with the rigid chain links 910 driven through the rigid chain drive housing 902, with the extending rigid chain positioned in a chain guide 920. The systems 900 operating together can provide desired lifting characteristics as the chain drive systems 900 are capable of supporting significant loads, allow for quick raising and lowering speeds, are accurately positioned adjacent a berth for storage or removal of a watercraft or otherwise, are easily maintained and operate both efficiently and quietly. Alternatively, other raising/lowering systems may be used in association with the lift frame 828, such as a cable hoist, crane lift, or other suitable systems.

Figure 41:
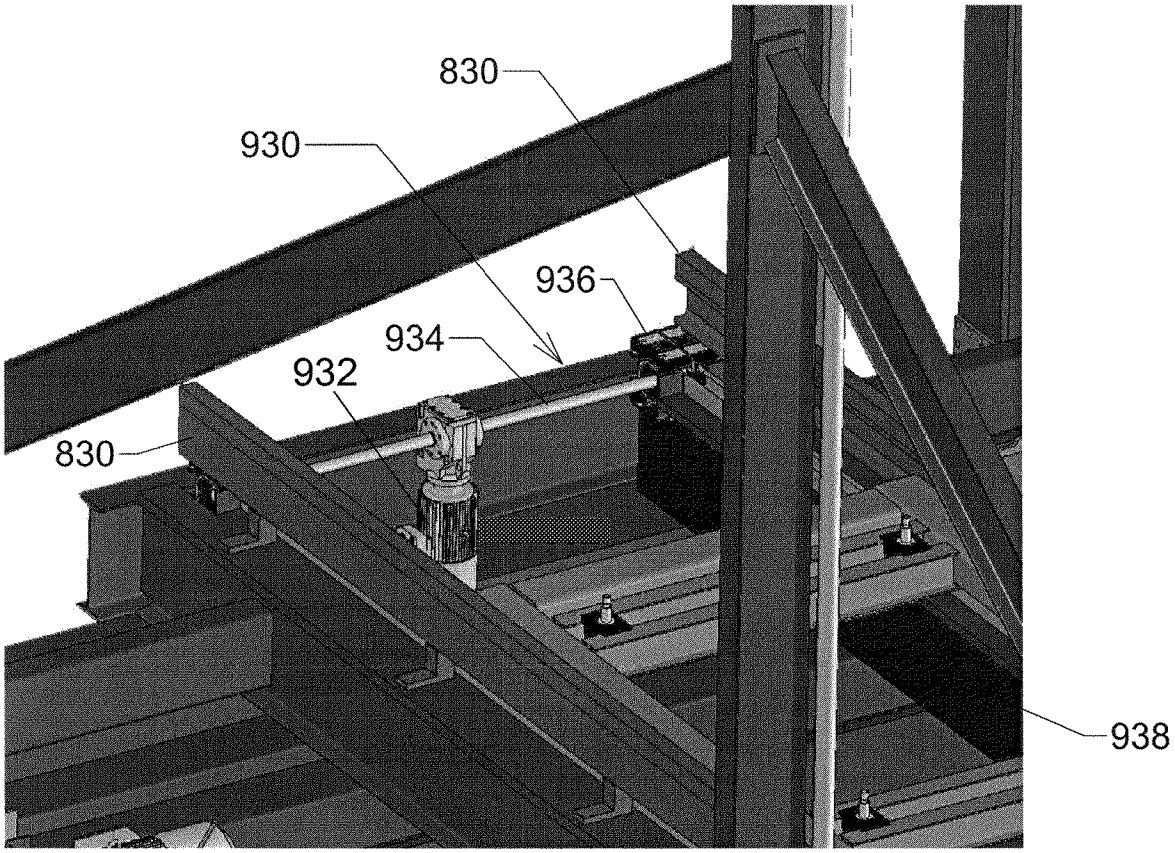
FIG. 41 shows a partial view of tug drive system according to an example.

Turning to FIG. 41, there may also be a chain drive system 930 used in association with the lift frame to operate the movement of the watercraft or otherwise to and from the lift frame and an adjacent berth. The drive system 930 may include a push/pull motor 932 operating a drive shaft 934 coupled to a chain drive 936. A tug system (not shown) may be moved to and from the lift frame on tug guide rails 830 by the chain drive system, that allows push/pull movement of the tug system into or out of a berth and off or onto the elevator lift as desired. A chain storage 938 may be provided to house a length of chain needed to fully push or pull the tug system into or out of a berth and onto or off of the elevator system. Other systems to allow movement of the tug system and correspondingly of the watercraft or otherwise to and from the elevator may be used if desired.

Figure 28:
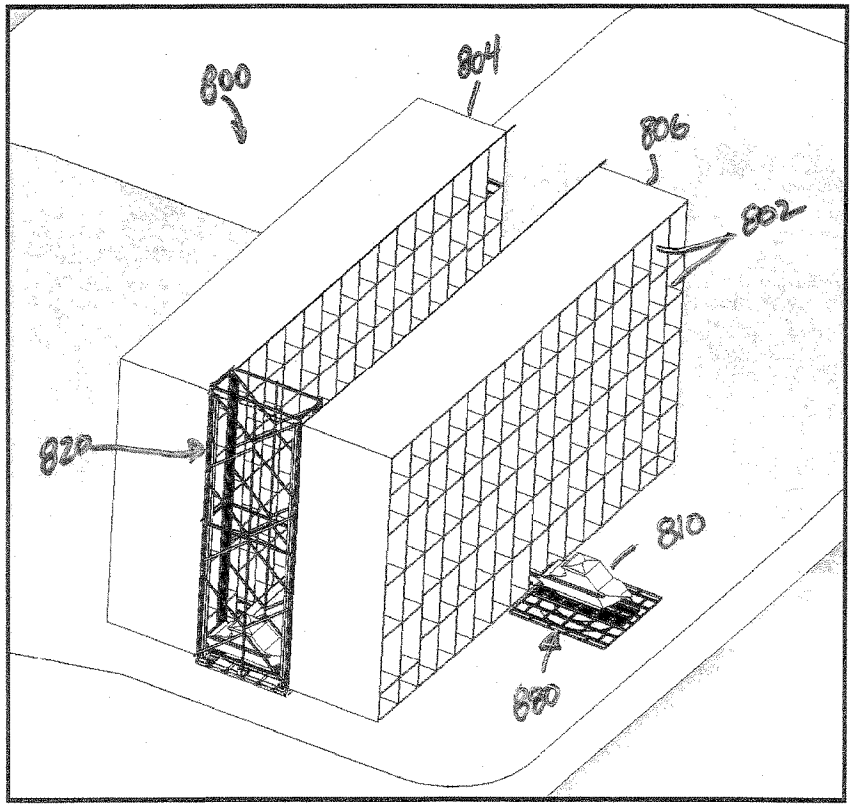
FIG. 28 shows an alternate example of a storage system according to the invention.
Figure 42:
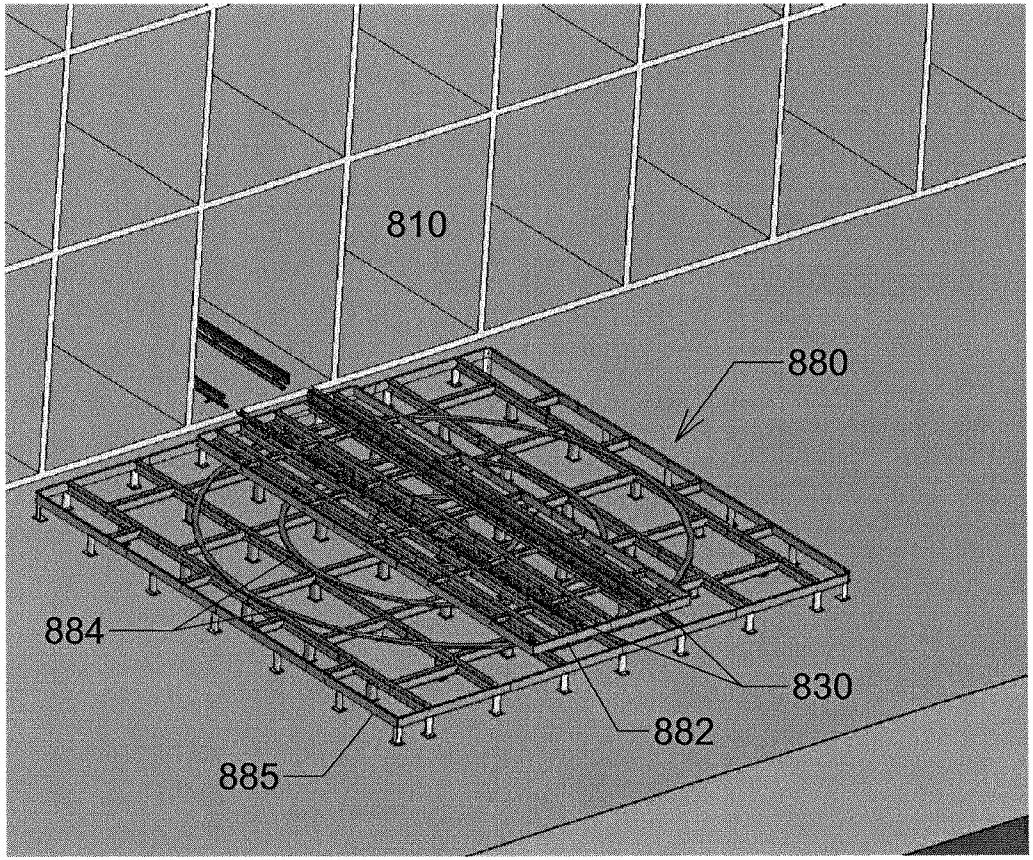
FIG. 42 shows a turntable loading/unloading system according to an example.

Also in this example, the storage system 800 may utilize one or more other systems to move watercraft 810 into and out of berths 802. As shown in FIG. 28 for example, one or more turntables 880 may be provided for positioning watercraft 810. As seen in FIG. 42, the turntable system 880 is shown in more detail. In use, the turntable system 880 may be positioned adjacent a berth 810, and allows positioning of a watercraft and carrier thereon via the guide rails 830. The guide rails 830 are provided on a support frame 882 which is selectively rotatable to position guide rails 830 in a desired orientation for loading a watercraft thereon, and for positioning into or retrieving a watercraft from berth 810. The frame support 882 may be mounted on base support 885 via a set of bearings, and include support wheels that are aligned with circular tracks 884, and may be driven by a motor to selectively rotate the frame 882 relative to base 885. As seen in FIG. 42, the rails 830 may thus be aligned with rails 886 in berth 810, and a watercraft can then be selectively moved into or out of the berth 810 on a carrier or cassette via a tug system as previously described. Such a loading/unloading system may be used in the various example systems to facilitate handling of watercraft or other items in an efficient, effective manner. Various systems may be used to position the watercraft or otherwise on the turntable system 880, and multiple systems 880 may be used if desired.

Figure 43:
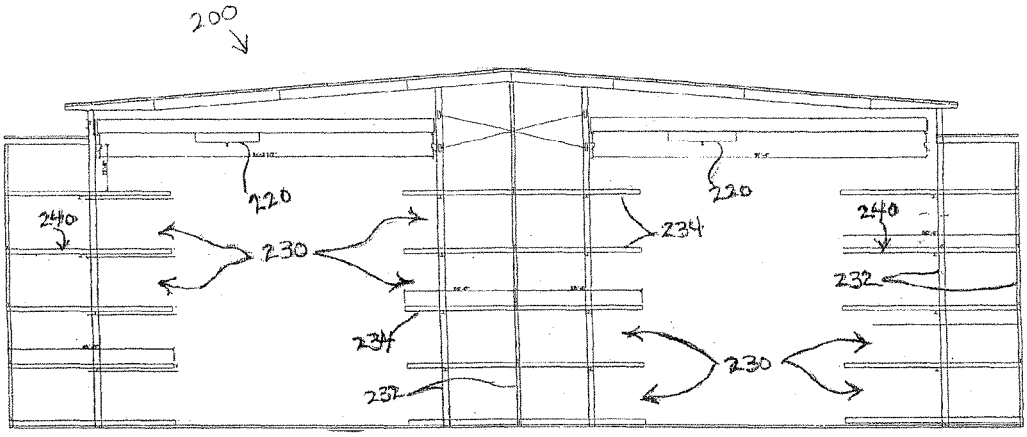
FIG. 43 is a cross sectional view of another example of the dry stack watercraft storage system according to the invention.
Figure 44:
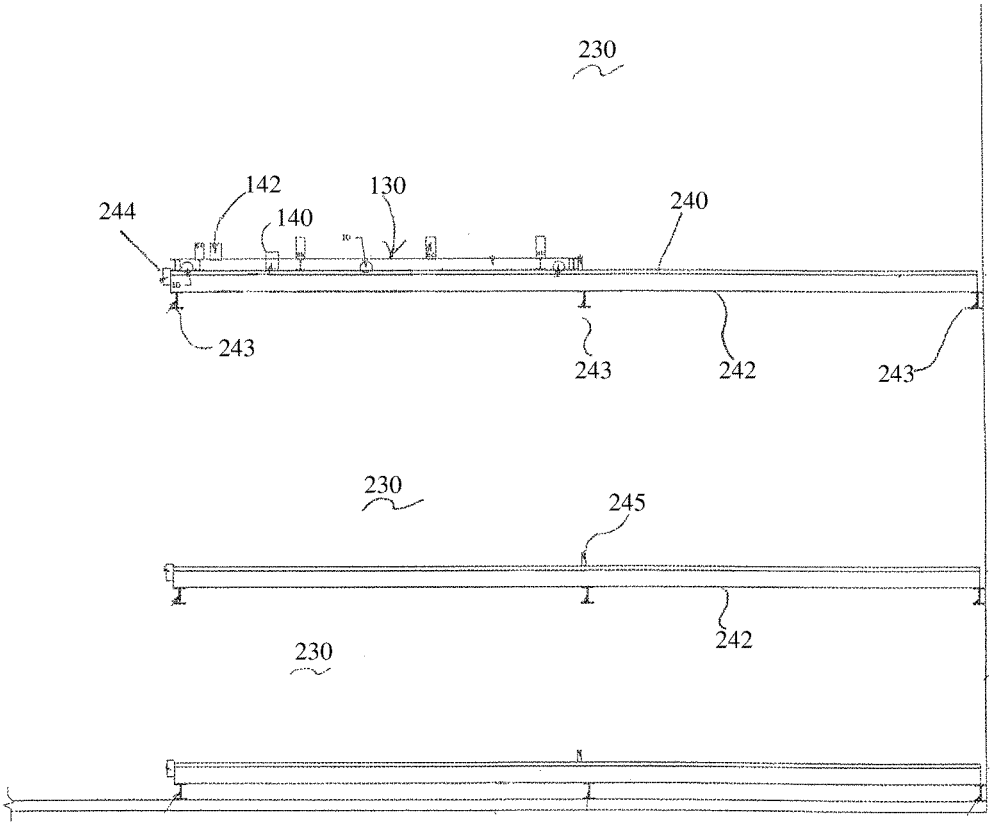
FIG. 44 is a partial side view of a support system according to the example as shown in FIG. 43 with a carrier system shown positioned therewith.
Figure 45:
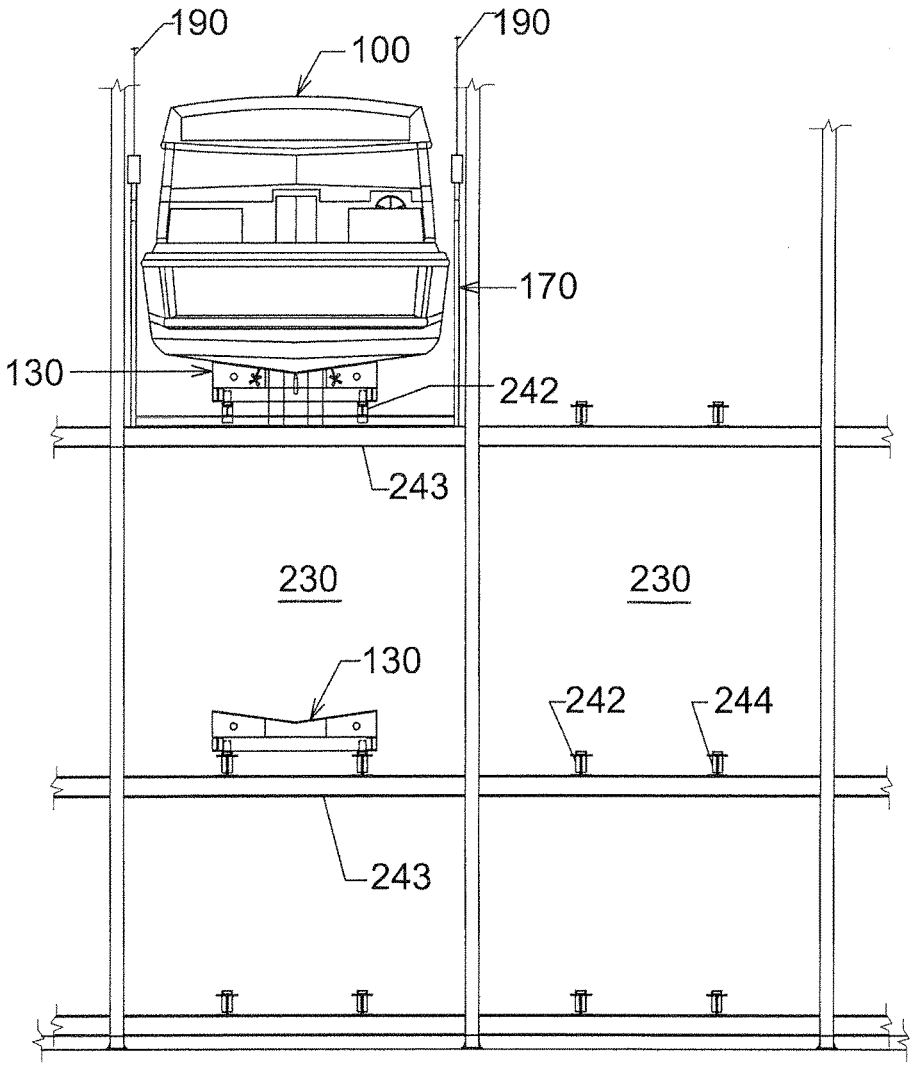
FIG. 45 is a partial front view of a plurality of bays associated with the system shown in FIG. 43.
Figure 46:
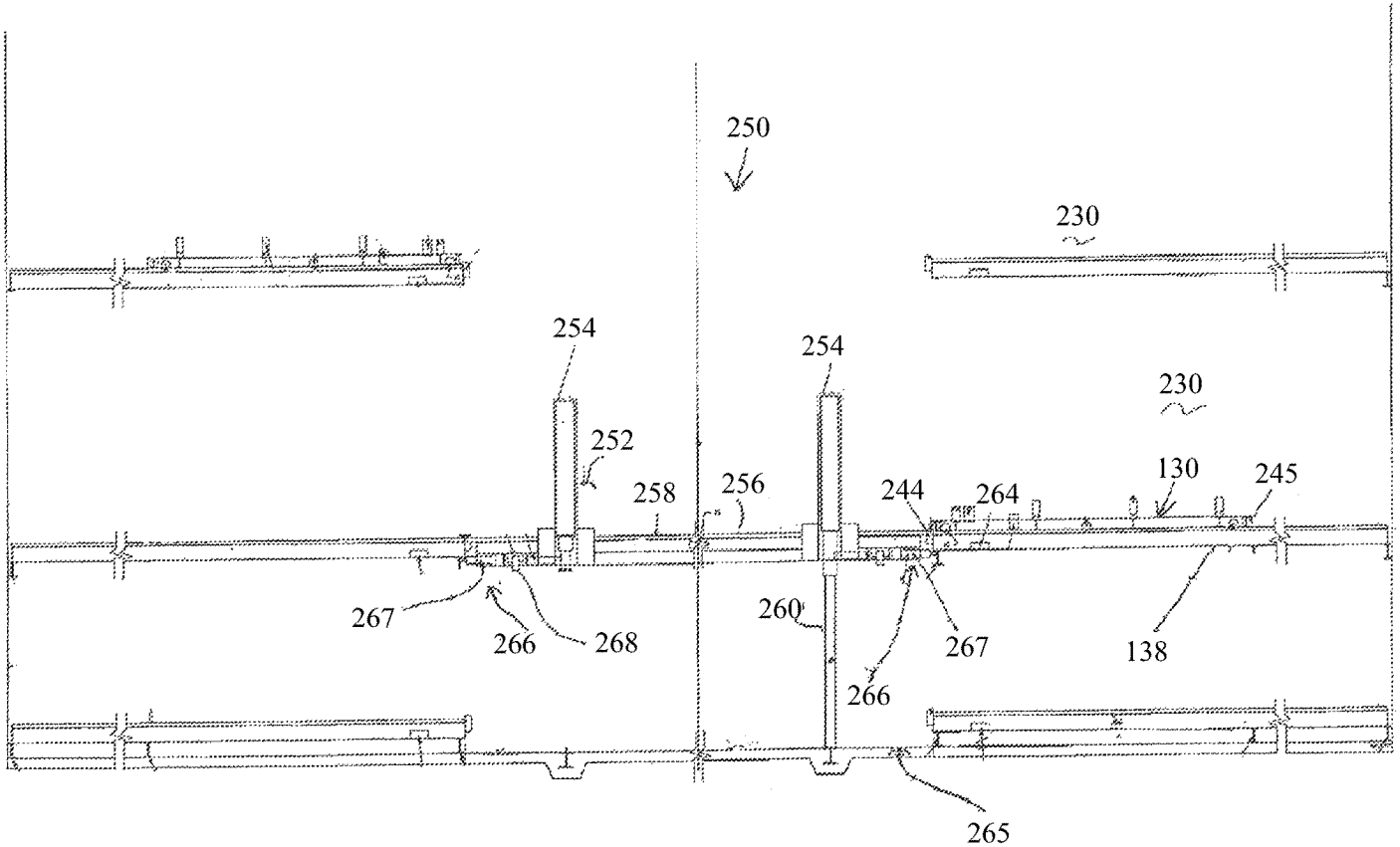
FIG. 46 is a partial side view of an example of a positioning system including an elevating system of an example of the invention.
Figure 47:
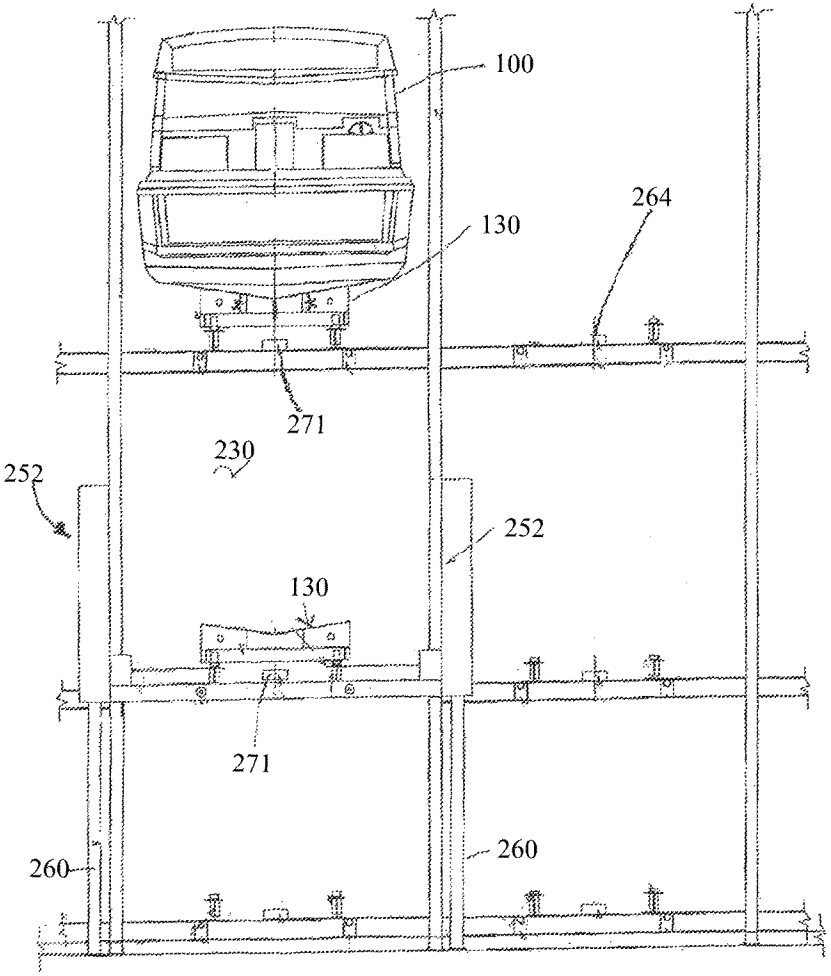
FIG. 47 is a partial front view of a plurality of bays in conjunction with the elevating system as shown in FIG. 46.
Figure 48:
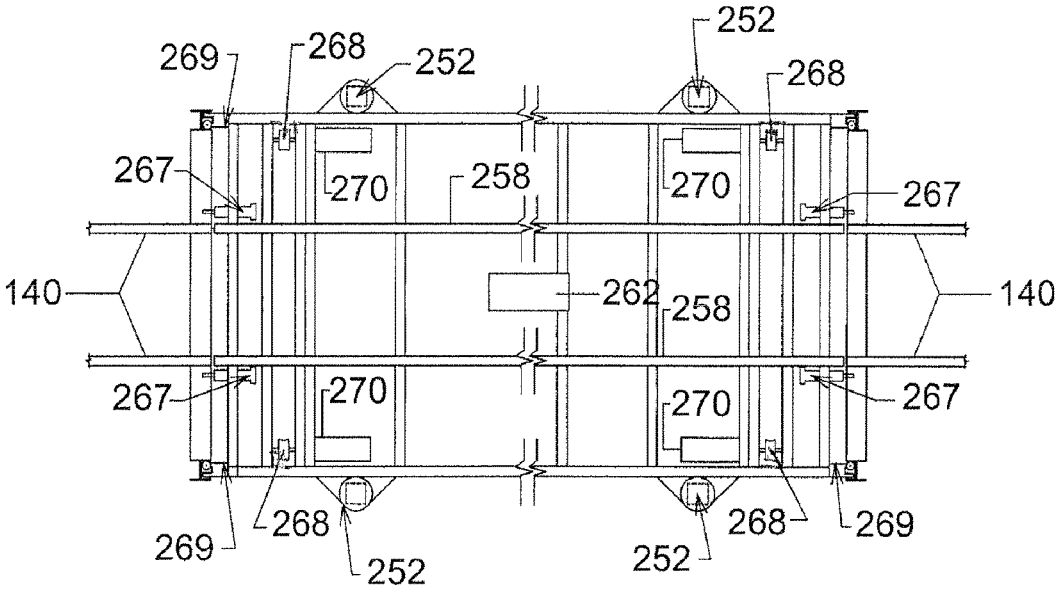
FIG. 48 is a partial top view of the elevating system as shown in FIG. 46.
Figure 49:
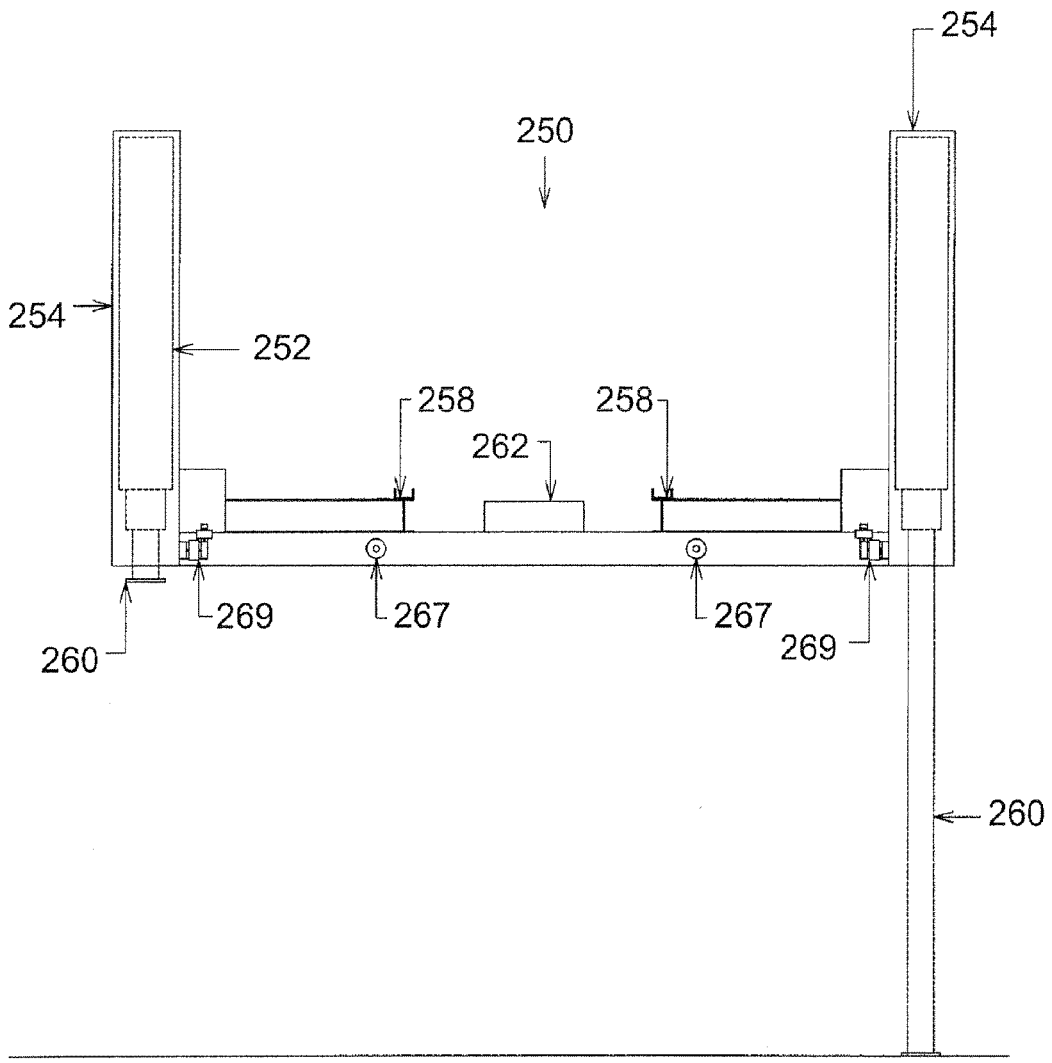
FIG. 49 is a partial cross-sectional view of the elevating system as shown in FIG. 46.

A further example of the invention is shown in FIGS. 43-45, wherein an alternative watercraft (or other craft such as aircraft) support system is provided in the facility 200, which works together with one or more lifting and positioning systems 220 for positioning a watercraft 100 in a storage position within the facility. In this example, the watercraft support systems are formed as a plurality of bays or berths 230 formed in a vertically stacked type of arrangement within the facility 200. As shown in this example, the facility may include vertical support columns 232 and horizontal support beams 234 to form the berths 230. As an example, a series of vertical support columns 232 are positioned in spaced apart locations adjacent the wall of the enclosure 200, with another series of vertical columns positioned outwardly from the wall in spaced relationship, a predetermined distance from the wall. The distance between columns may be varied to allow watercraft of different widths to be efficiently accommodated. The horizontal support beams may be positioned between adjacent vertical columns along the wall and between the outer columns to form rear and forward supports for the support system 240 in the berth 230. To facilitate configuring a bay 230 to accommodate a variety of watercraft, the horizontal support beams 234 may be adjustably positioned on the vertical columns 232 to vary the size of the opening forming an individual bay 230. Such adjustability can be provided by any suitable system, such as a series of mounting holes formed in the vertical columns 232, which are used to selectively mount the horizontal support beams 234. Mounting holes may be formed to allow repositioning of the support beams 234 in predetermined increments upwardly or downwardly for example. Other mounting arrangements to allow repositioning of the beams 234 are also contemplated. In this manner, a wide variety of watercraft 100 may be positioned in the bay 230. This also provides the ability to form the bays 230 in a configuration to efficiently accommodate different watercraft within the given space of the facility 200. In some facilities 200, the rear support beams positioned along the wall of the enclosure may be a part of the building structure, and therefore may be fixed. In such an example, the forward support beams 234 may be adjustably positioned, and if positioned relatively above or below the corresponding rear support 234, a suitable spacer (not shown) may be used in association with a rear support 16 to provide a substantially horizontal support in conjunction with the forward support 234. Such spacer may use either a lower or higher rear support as the spacers supporting beam. The structure provides a strong frame structure for supporting watercraft of various sizes and configurations. The columns and beams may be configured as I-beams or other suitable configuration. The frame system may provide support and protection of watercraft 100 stowed in the storage system 10.

As shown, several bridge crane systems 220, such as of different load bearing capacities (e.g. 50 and 30 ton cranes), are provided to efficiently handle different size watercraft using the facility 200. The cranes 220 may include a system to rotate the watercraft into any desired orientation, as well as allowing for the adjustment of the cranes lifting cable spacing to suit an adjustable cradle and carrier system width as may be adjusted from time to time. Other suitable lifting systems are also contemplated, such as stacker cranes, captive aisle cranes or the like. In this example, a support system 240 is provided in each bay 230, such as is shown in FIGS. 44 and 45. As shown in FIGS. 44 and 45, the support system 240 may be formed as a wheel guide similar to the prior example, to receive a carrier similar to the carrier 130 described previously. The wheel guide system may be positioned via a wheel guide and support channel 242 provided in association with each berth 230. A plurality of support beams 243 may be provided to support the wheel guide and support channel 242. A carrier anti-roll lock 244 may be provided similar to that described earlier. In this example, the watercraft operational systems 140 and 142 may be provided in association with carrier 130 as an example, and coupled to utility supplies by suitable interfaces provided in association with each berth 230. The carrier 130 and/or support system 240 may also have suitable drive systems associated therewith for movement of the watercraft/carrier into and from each berth 230, similar to that described previously. The watercraft/carrier may be lifted and positioned in a berth 230 by one of the cranes 220 using a cradle system 170 similar to that described previously. Upon movement of carrier 130 into bay 230, a forward stop 245 may be provided in association with the wheel guide and support channel 242 to limit inward movement of carrier 130 and watercraft 1.00 to a desired extent.

As seen in FIG. 45, the carrier 130 may support watercraft 100 as previously described, and be lifted and positioned relative to a bay 230 by the lifting/positioning system 220 and support cradle 170. The carrier 130 and watercraft 100 may then be moved from the cradle 170 into bay 230 and onto the wheel guide and support channel 242 positioned in each bay 230 for storage, with the position of carrier 130 in bay 230 retained by carrier anti-roll locks 244 as an example. Removal of watercraft 100 from storage is simply provided by positioning cradle 170 adjacent bay 230 and moving carrier 130 onto the cradle in a reverse fashion.

Alternatively, the lifting and positioning system may be an elevator type of arrangement, such as shown in FIGS. 46-49. In this example, the lifting and positioning system 250 may be a system positioned in the aisles of the facility adjacent the bays 230, and may comprise, as merely one suitable form, a vertical guide system 252 having a plurality of lift columns 254 supporting a movable platform 256. On the platform 256, a wheel guide and support system 258 interfaces with the guide wheels 138 of carrier 130 for example. A suitable locking/anti-roll system may be used in association with the carrier 130 and/or platform 256 when the carrier 130 is on positioning system 250. The watercraft 100 and carrier 130 may be placed on the positioning system 250 in any desired manner, such as by a rail type system 265 on which the watercraft/carrier is transported at ground level, or any other suitable system.

The lift columns 254 may then be used to elevate the watercraft/carrier in any suitable manner, such as by hydraulic lift cylinders 260 which selectively lift the support platform 256 to the desired bay 230 on either side of the aisle. Alternatively, any other suitable system for vertical movement of platform 256 is contemplated, such as another system to push the platform 256 upwardly, hoist cables to lift the platform 256 from above, a cog/gear arrangement to climb a lift column 254 or any other suitable system.

The platform 256 may have drive rollers 268 and associated drives 270 (see FIG. 48), to allow it to be moved along the ground floor to a particular stack of berths 230 if desired. Once the platform 256 is positioned relative to the bay 230 in which the carrier/watercraft is to be positioned, a transport or conveyance system 262 (see FIG. 48) may be used to transport or push the carrier from the platform 256 and onto the mating wheel guide and support system 240 in the bay 230. For safety, the system 250 may include a vertical lock and alignment system 266, such as one or more locking pins 267, which are made to selectively extend into associated apertures adjacent the bay 230. To ensure proper positioning of platform 256 relative to a bay 230, a vertical locating unit 269 may be provided. These systems properly position the platform 256 and prevent any vertical movement or dropping of the platform 256 relative to bay 230 when transferring a watercraft/carrier into or from bay 230. When transferring the watercraft/carrier from bay 230 onto the platform 256 to retrieve it from storage, a conveyance system 271 associated with the support system 240 may be used to transport or push the carrier 130 from the bay 230 and onto the mating wheel guide and support system 258 on the lift platform 256. Alternatively, the carrier 130 may have a suitable conveyance system to move itself between the platform 256 and bay 230.

Figure 50:
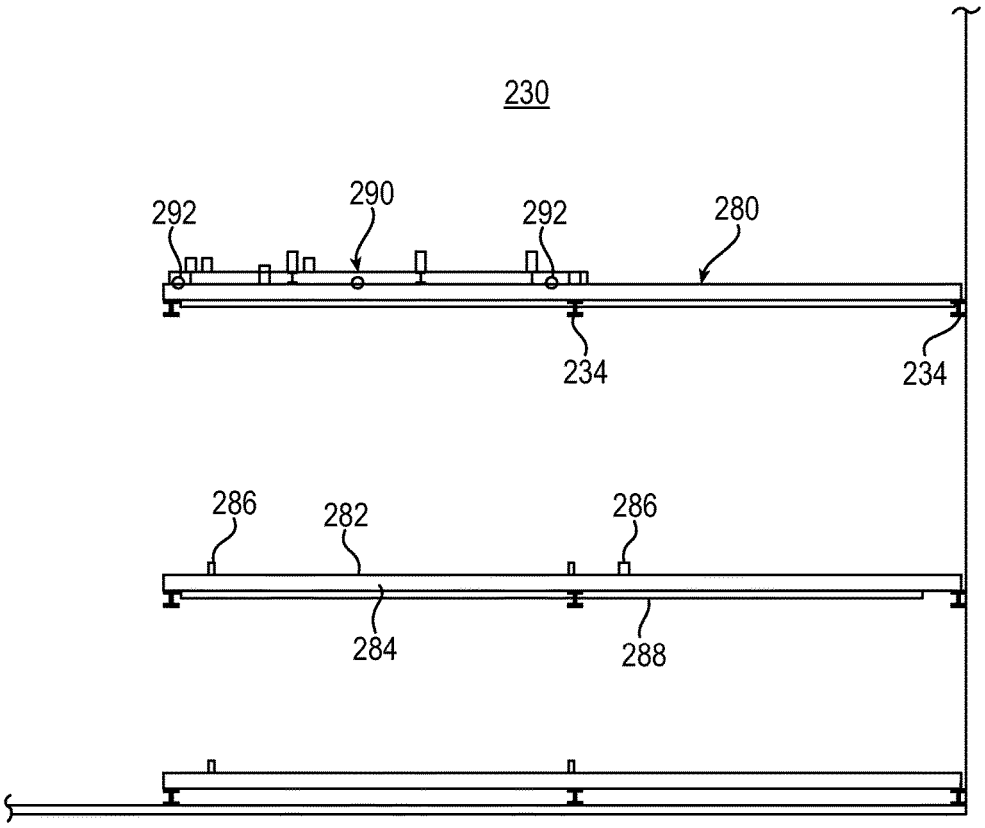
FIG. 50 is a partial side view of a support system associated with another example of the invention.
Figure 51:
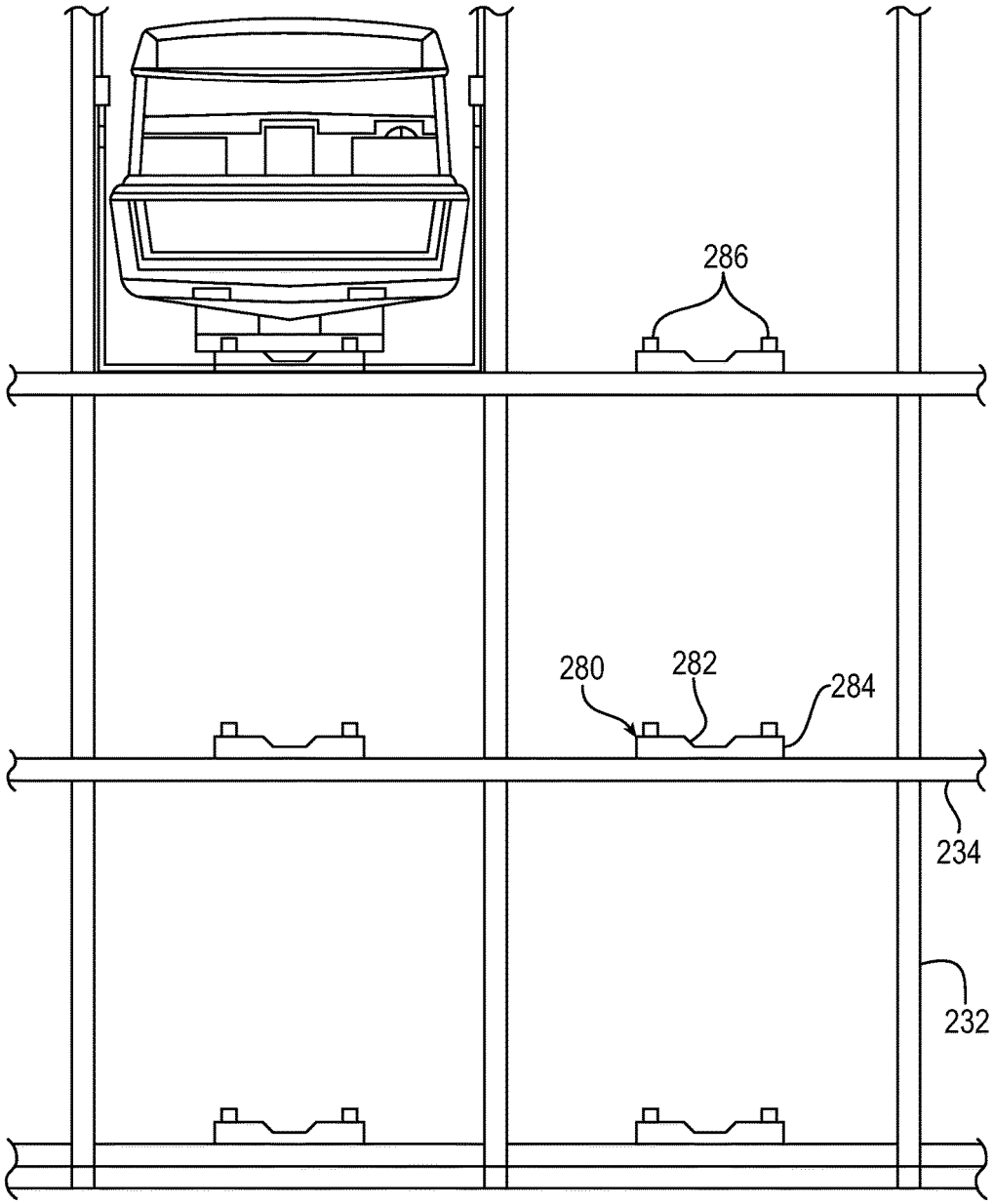
FIG. 51 is a partial front view of a watercraft positioned in a storage bay according to the example shown in FIG. 50.

In a further example of the invention, as shown in FIGS. 50-51, a different support system is provided in each bay 230 in a facility 200. Mounted within each bay 230 is a support system 280 formed as a cantilever support that extends from the rear support beam 234 and past the forward support beam 234 in the center of the bay 230. The cantilever support 280 cooperates with a carrier 290, which is designed to support the watercraft 100 in position in association with the cantilever support 280 similar to prior embodiments. The cantilever support 280 comprises in this example, a generally rectangular formed channel member, constructed of steel or other suitable material. The cantilever support 280 may be formed to have a top surface 282, and side walls 284, with an open bottom. Within the open bottom channel formed by the cantilever support 280, there may be provided a fire suppression system, generally designated 288. In general, the fire suppression system 288 will be mounted in the bottom of the cantilever support 280 of each berth 230, to protect the watercraft 100 in the berth below the system 288. In this way, each watercraft in the facility is protected by an individual fire suppression system. For watercraft positioned in a top bays 230, a separate fire suppression system may be provided. The cantilever support 280 also comprises carrier locating members 286 on the top surface 282. The carrier locating members 286 may be positioned at predetermined positions along the length of the cantilever support 280 to properly position the carrier 290. The locators 286 may simply be upstanding posts that mate with apertures 292 provided on the carrier 290, and thereby securely position the carrier 290 in a predetermined position relative to the cantilever support 280. Any other suitable positioning system to accurately position the carrier 290 with respect to the cantilever support 280 is contemplated. It should also be recognized that the characteristics of the cantilever support 280 may be adapted to the particular watercraft to be supported thereon, such as having a predetermined width, length or other characteristics to properly support a particular watercraft 100.

Figure 52:
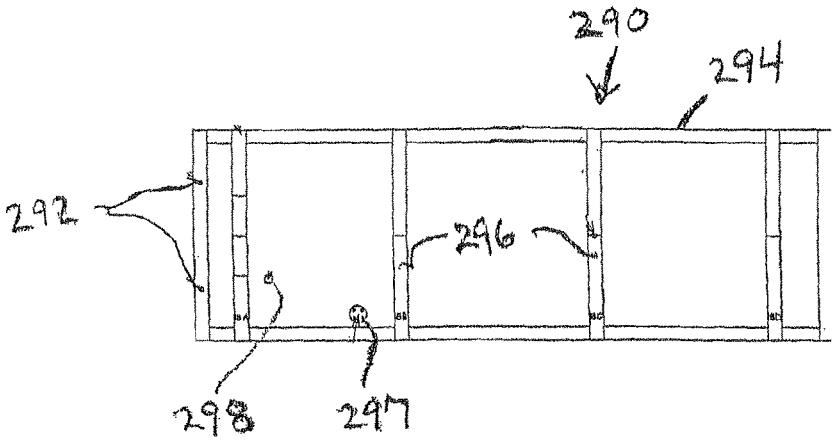
FIG. 52 is a top view of a carrier system according to another example for use with the support system in the example of FIG. 50.
Figure 53:
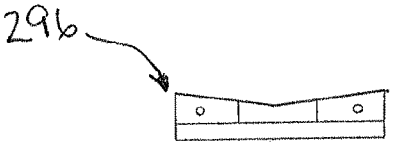
FIG. 53 is a front view of the carrier system as shown in FIG. 52.

In this example, the carrier 290 as shown in FIGS. 52-53, may be somewhat similar to that previously described, including a frame 294 and hull supports 296, but it does not need the wheels of prior embodiments. Watercraft operational systems, such as electrical supply 297 and water circulation system 298 may also be provided.

Figure 54:
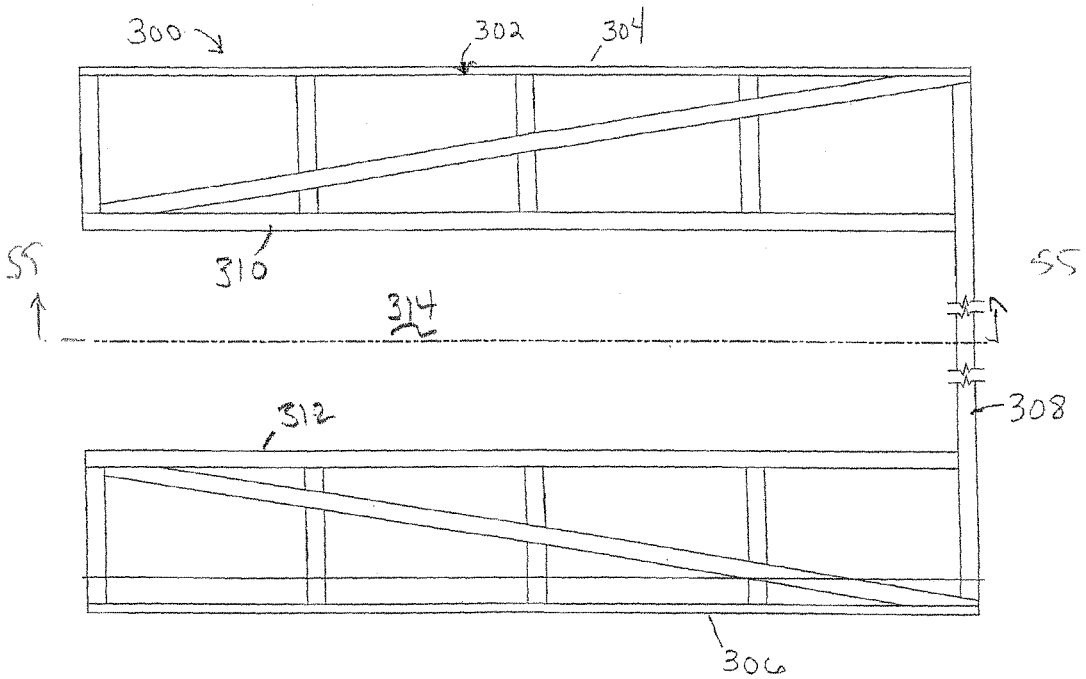
FIG. 54 is a top view of an example of a cradle system for use in the storage system example as shown in FIG. 46.
Figure 55:
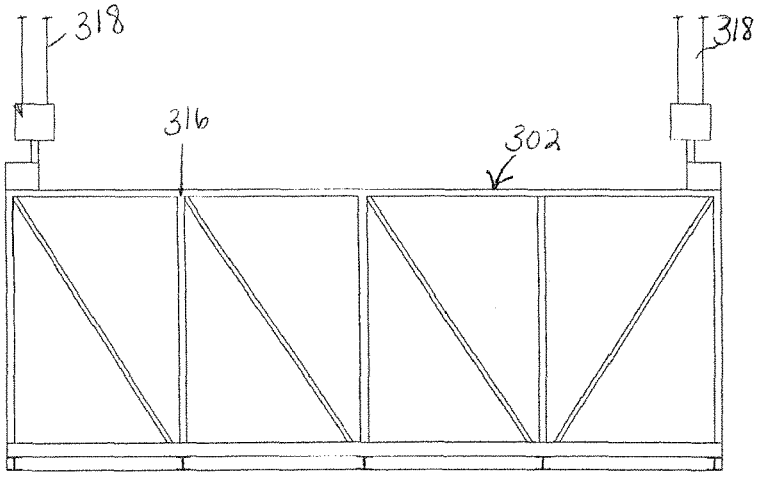
FIG. 55 is a cross sectional view taken along line 55-55 of FIG. 54 of the cradle system.
Figure 56:
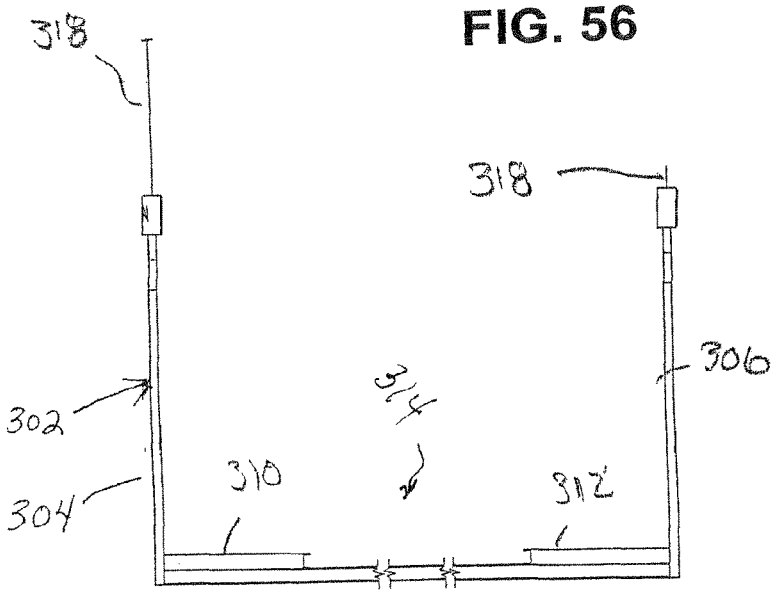
FIG. 56 is an end view of the example of a cradle system as shown in FIG. 54.

The invention contemplates using any number of locating systems from mechanical stops, intelligent optics, laser targets, ultrasonic sensing and other suitable systems that can be used as the watercraft is lifted from the water or intermediate positioning system in the carrier 290, and positioned into the desired berth or bay associated with any of the examples. Computer control of all systems allows for efficient and effective positioning of craft or other items. Further, in this example, as shown in FIGS. 54-56, a cradle system 300 similar to that described previously may be provided. The cradle system 300 may comprise a frame assembly 302 having a first side 304, second side 306, having a predetermined height, which may be configured to exceed the keel to gunnel height of watercraft to be handled for example. An end 308 may provide adjustability of the width between walls 304 and 306. The height of the walls 304 and 306 may be determined by each storage facility's needs relating to the type of watercraft 100 to be lifted thereby. The frame assembly 302 thereby provides open ends into which the watercraft 100 may be maneuvered in the body of water for loading for example. The frame assembly 302 further comprises first and second bottom walls 310 and 312 which extend toward the center of the cradle system 300 a predetermined distance, leaving an open central area 314 therebetween. The bottom walls 310 and 312 may include a system for securely engaging the carrier frame 294 to securely support the carrier 290 when being lifted and positioned with the watercraft 100 thereon. The locking system may be of any suitable type, such as an interlock system that engages the carrier 290, so as to provide a secure, temporary engagement with the carrier 290 in a manner to lock the bottom walls 310 and 312 together with the carrier 290 and resist any spreading of the bottom walls when loaded with a watercraft 100. In operation for example, the carrier 290 is locked into position with the cradle system 300, and is positioned in the water for the watercraft 100 to maneuver into position over the carrier 290. Generally, the center of gravity of the watercraft positioned in the cradle 300 is positioned at approximately the location noted at 316. The carrier and cradle are lifted into proper engagement with the watercraft 100 and then lifted and positioned in the predetermined bay. Upon being supported on a cantilever beam 28 the interlocking system of the cradle 290 simply releases from engagement with the carrier 290 upon being lowered therefrom. It should also be recognized that the cradle system 300 allows movement of the cradle/carrier/watercraft into the bays 230 without interference with the columns 232, beams 234 or cantilever support 280, and lowered into the desired position on the cantilever support 280. Further, to accommodate various width watercraft 100, the cradle system 300 may have an adjustable width. The cradle system 300 may have an end wall 308 which allows adjustment of the width in any suitable manner.

Figure 57:
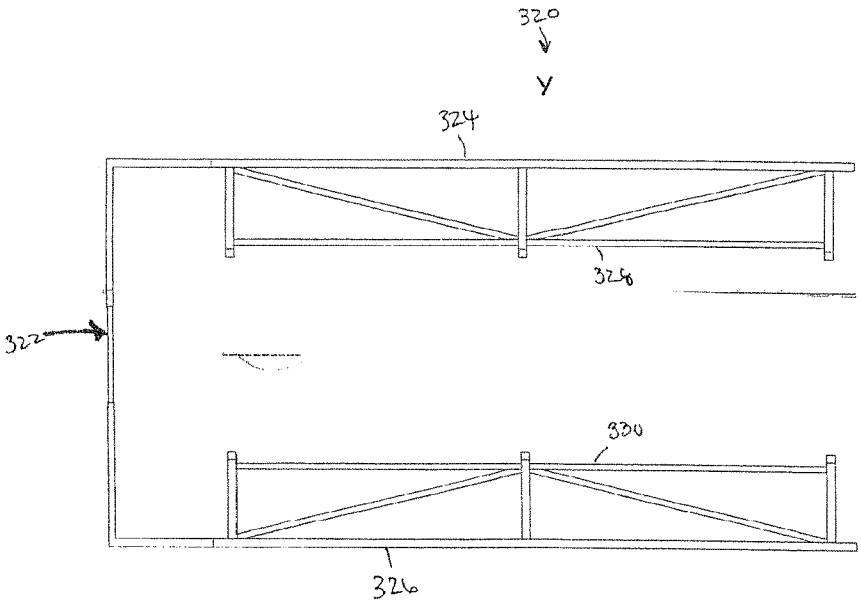
FIG. 57 is a top view of an alternate cradle system according to the invention.
Figure 58:
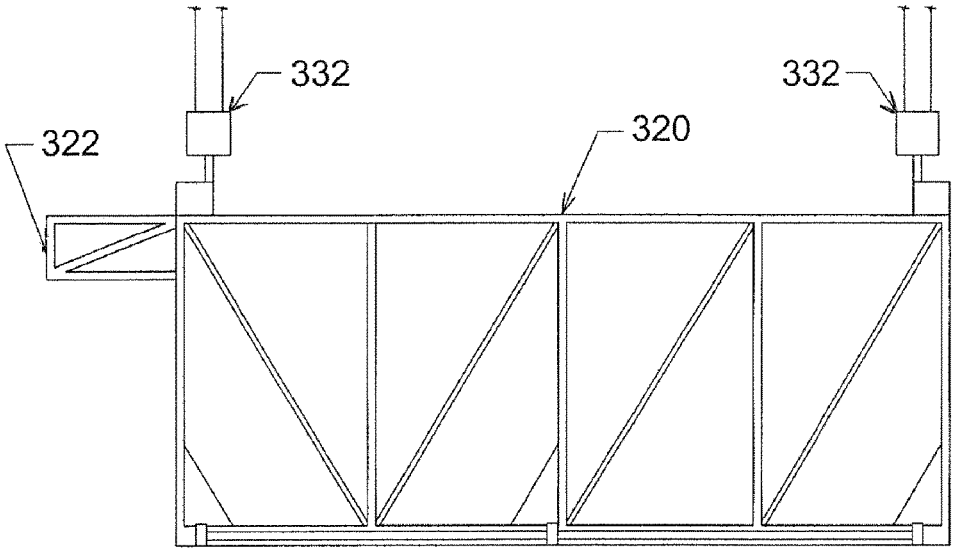
FIG. 58 is a cross-sectional view of the cradle system as shown in FIG. 57.
Figure 59:
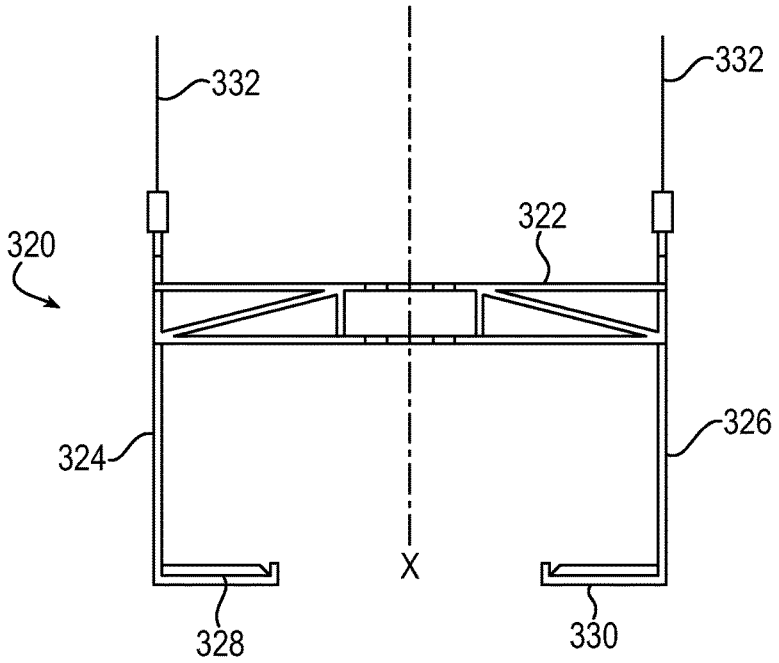
FIG. 59 is an end view of the cradle system as shown in FIG. 57.

In an alternate example of a cradle system as shown in FIGS. 57-59, the cradle 320 may have an end wall 322 which may be a frame extending away from the side walls 324 and 326, such that it will not interfere with the proper positioning of a watercraft 100 in the cradle system 320. The end wall 322 may have one or more telescoping sections to allow adjustment of the width, either by manual or powered width adjustment, that may be controlled either manually or by computer control, to fix a desired relative position between each bottom wall section 328 and 330. Similarly, the position of the crane cables 332 can be adjusted in association with the cradle in any suitable manner. Upon adjustment of the width of the cradle 320, the crane cables 332 are desirably repositioned to be in line with the cradle connections for lifting the cradle 300 in a safe and stable manner.

Figure 60:
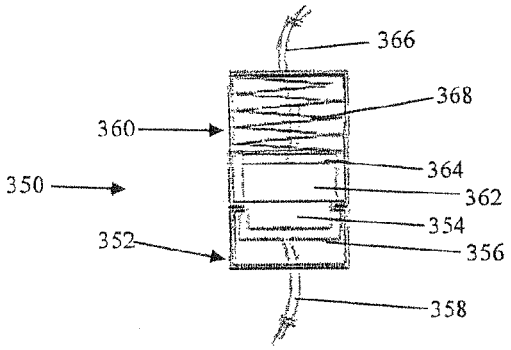
FIG. 60 is a partial view showing the electrical supply system according to an example for use in the storage system of the invention.
Figure 61:
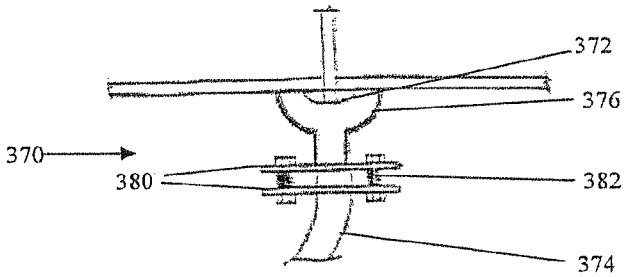
FIG. 61 is a partial view showing the fluid supply system according to an example for use in the storage system of the invention.

Turning now to FIGS. 60 and 61, watercraft operational system connections are shown in more detail according to an example of the invention. Such systems or similar systems may be used in the various examples of the invention. The electric supply system 350 which may be provided in any of the examples above, is shown in more detail in FIG. 60. In an example, the system 350 may be configured such that the electrical connection of a power supply, such as the electric utilities of the facility, occurs automatically upon positioning the watercraft 100 in its storage position within the facility. In the examples using a bay or berth, the supply system 350 may comprise a base unit 352 which is mounted within the bay 230 in a suitable manner to automatically connect to the system associated with the carrier. The base unit 352 may have an electrical conductor pad 354 and associated insulator pad 356, which are electrically connected to an electrical supply line or feed 358. The base unit is generally fixed in a predetermined position, or could be made to have its position adjustable. The location of the base unit 352 is predetermined to correspond to the position of a mating upper contact unit 360 which is positioned with the carrier or in association with the watercraft 100. The upper contact unit 360 may also comprise an electrical contact pad 362 and associated insulator pad 364, electrically connected to a load line 366 which feeds power to any watercraft systems as desired. The contact 362 is adapted to mate with contact 354 associated with the base unit 352. To facilitate making the electrical connection between the contacts 354 and 362, one or both of the contacts may be spring loaded to exert an outward force on the contact which will ensure proper physical connection between the contacts 354 and 362. As an example, the upper contact 362 may be biased outwardly by means of spring member 368 to exert an outward pressure on contact 362 and against the mating contact 354. Any other suitable system for supplying electrical power to the watercraft when stored is contemplated. Different electrical-requirements, including all combinations of AC and/or DC power or any approved electrical connectors may be provided via the supply system 350 according to the invention. For example, the supply system 350 may provide 110 volt and/or 220 or 440 volt service, and may include ground and negative and positive connection terminals for 110/220 volt service, or three phase power and ground connections for 220/440 volt service. Any other desired electrical supply is also contemplated. It may also be desirable to provide a plurality of systems 350, either on a common support or individual supports, mounted in positions to ensure proper connection to the electrical power supply of the facility. Power connections will be set up to accommodate any or all electrical supply configurations now existing or that may be developed in the future. The electrical supply may also be usable to operate the fire suppression system described above. The electrical supply system may also be coupled through a metering system for tracking electricity use associated with any particular watercraft 100 stored in the facility.

Turning to FIG. 61, an example of the fluid circulation system 370 is shown in more detail. The circulation system 370 is designed to work in conjunction with the onboard fluid or water circulation system of the watercraft 100 for example. Typically, the watercraft 100 has a water intake port and a separate water exhaust or drain port associated therewith. An intake and/or drain port 372 associated with the watercraft 100 is normally positioned through the hull of the watercraft 100. The port 372 is coupled to the intake or drainage plumbing of the watercraft 100 to circulate water to and from the air conditioning system of the watercraft 100 for example. The port 372 is selectively and automatically coupled to the circulation system 370 when the watercraft 100 is positioned in a bay of the facility for example. The system 370 may comprise a suitable plumbing line 374 coupled to an adjustable housing 376, which may be shaped in a plunger like shape or fluid connector shape or material that will seal any fluid being delivered to or returned from the boat into a "catch" system. This will allow latitude in the coupling position in association with the port 372. The bell housing 376 may also be formed of a suitable material to allow sealing of the housing 376 with the hull of watercraft 100. To further facilitate proper coupling and sealing of the housing 376, the housing 376 may be formed of a resilient material which will allow some amount of collapse of the housing 376 when it engages the hull. To also facilitate proper engagement of the housing in association with the hull, there may be provided a spring biased mounting system 378, such as a pair of mounting plates 380 coupling the plumbing line 374 to the housing 376, with a bias spring 382 positioned therebetween. This arrangement provides a biasing force outward on the bell housing 376 to facilitate proper sealing engagement and sealing pressure between the connector and with the hull.

In yet a further example of the invention, an alternate support system may be provided in the facility; which uses one or more vertical support systems provided on one or more levels within the facility. The vertical support systems may be provided as a conveyor type system arranged along a movable path, to move watercraft 100 positioned thereon to any position within the facility on a level. The number of watercraft 100 positionable on the support system is variable dependent on the size of the support system. Systems such as the carriers and lifting systems may be used to position watercraft on the vertical support system. The vertical support systems may be a vertically oriented carousel support system, such as similar to those produced by Intertex Carousels Corporation or the like. In such systems, instead of being oriented in the horizontal position, the support system 320 may be oriented in vertically oriented support loops or serpentine arrangements for example. The support system would be provided to support the number and size of watercraft 100 as desired.

As yet another example of the invention, a storage facility could be constructed to have interior spaces through which watercraft are moved for positioning in or from a storage position. Watercraft 100 could be brought into or out of the facility either by means of a channel and/or the use of one or more intermediate lifting and positioning systems to position the watercraft 100 on a transfer system within the facility. The transfer system may be of any suitable type to support the watercraft and allow movement to and from its storage position, such as a rolling conveyor or carrier supported on wheels to allow movement, or air bearings that allow the support to "float" above the floor using compressed air. Alternatively, a rail system may be provided on the lower floor along which watercraft can be moved and positioned temporarily or for storage/removal from a particular watercraft storage position. In an example, as shown in FIGS.

In other examples of the invention, combinations of systems as described may be used, such as to allow a lifting crane system to move watercraft while concurrently allowing watercraft to be positioned in a storage position by other lifting and positioning systems for example. Each example may also utilize the watercraft operational systems as previously described, or other aspects in combination. There may also be provided a washing station for washing of watercraft in the facility before or after storage, or other functions.

While particular examples of the present invention have been illustrated and described, it is not intended to limit the invention, except as defined by the following claims.

What is claimed is:

1. A system for moving and storing items comprising:

a plurality of storage areas for receiving and supporting at least one item, the plurality of storage areas including at least two floors, at least one item positioning system provided on each floor to engage and support the at least one item for movement of the item, at least one elevator system for supporting and moving the at least one item in association with one of the at least two floors, and a control system for controlling the at least one item positioning system and said at least one elevator system to move the at least one item to and from a storage area on one of the at least two floors, wherein the at least one item positioning system includes a drive system controlled by the control system to move the at least one item.

2. The system of claim 1, wherein a plurality of item positioning systems are provided in association with each floor.

3. The system of claim 1, wherein the at least one elevator system is selected from the group consisting of a traveling elevator, a rigid chain lift, a crane, hoist cables, a cog/gear arrangement or combinations thereof.

4. The system of claim 1, wherein the at least one item is selected from the group consisting of a shipping container, a watercraft or an aircraft.

5. The system of claim 4, wherein a plurality of items are temporarily stored in the plurality of storage areas and the control system tracks the location of each item.

6. The system of claim 4, wherein the at least one item positioning system is selected from the group consisting of a chain drive, a push/pull drive system, a tug system, a turntable system or combinations thereof.

7. The system of claim 1, wherein the at least one elevator system is positioned exterior to and/or within the plurality of storage areas.

8. The system of claim 1, further comprising at least one transfer system to move the item from and to the at least one elevator system from a floor.

9. The system of claim 1, wherein the at least one positioning system includes a transfer system associated therewith.

10. The system of claim 8, wherein the transfer system includes a drive to move the transfer system.

11. The system of claim 1, wherein the at least one positioning system engages the at least one item or supporting structure.

12. The system of claim 1, wherein the control system positions the at least one item in at least one predetermined storage position on a floor.

13. A system for temporarily storing items comprising:

a plurality of storage areas formed on a plurality of floors of a structure, with at least some storage areas arranged laterally relative to one another on each of the floors, for receiving and temporarily storing a plurality of items, at least one item positioning system provided on each floor to provide movement of the item to and from a storage position, an elevator system to move the item to the item positioning system on one of the plurality of floors, and a control system which automatically controls movement of the at least one positioning system on each floor and said elevator system to position an item in a stored, wherein the at least one item positioning system includes a drive system controlled by the control system to move the at least one item and the control system includes systems to control movement of items to and from the stored position by controlling the at least one item positioning system to move the item to and from the elevator system.

14. The system of claim 13, wherein the at least one elevator system is selected from the group consisting of a traveling elevator, a rigid chain lift, a crane, hoist cables, a cog/gear arrangement or combinations thereof.

15. The system of claim 13, wherein the at least one elevator system is positioned exterior to and/or within the plurality of storage areas.

16. The system of claim 13, further comprising an item carrier system that is customized for the carrying of a predetermined item or has universal supports for carrying a plurality of items having different configurations.

17. The system of claim 13, wherein the control system positions the at least one item in at least one predetermined storage position on a floor.

18. The system of claim 17, wherein the at least one item is selected from the group consisting of a shipping container, a watercraft or an aircraft.

19. A system for storing large items comprising: a plurality of floors having storage areas, with at least some storage areas arranged laterally relative to one another, for receiving and supporting at least one item, at least one item positioning system on each floor for supporting an item and providing movement of the item to a storage position on a floor, and at least one elevator system to move the item to the item positioning system on a floor, and a transfer system to move the item from and to the elevator system; and a control system, wherein the at least one item positioning system includes a drive system controlled by the control system to move the at least one item and the control system automatically controls movement of the at least one item positioning system and the elevator system to position or retrieve an item from a storage area on one of the plurality of floors.

20. The system of claim 19, the control system controls the item positioning system to position the at least one item in at least one predetermined storage position on a floor.

* * * * *